US009074360B2

(12) United States Patent
Onodera et al.

(10) Patent No.: US 9,074,360 B2
(45) Date of Patent: Jul. 7, 2015

(54) FLOW CHANNEL OPENING/CLOSING APPARATUS

(75) Inventors: Naoyuki Onodera, Fukuoka (JP); Tsubasa Miyake, Fukuoka (JP); Tetsuya Uchida, Fukuoka (JP); Takuya Oshikawa, Fukuoka (JP); Takamasa Suzuki, Fukuoka (JP)

(73) Assignee: TOTO LTD., Fukuoka (JP)

( * ) Notice: Subject to any disclaimer, the term of this patent is extended or adjusted under 35 U.S.C. 154(b) by 416 days.

(21) Appl. No.: 13/638,408

(22) PCT Filed: Mar. 25, 2011

(86) PCT No.: PCT/JP2011/057386

§ 371 (c)(1),
(2), (4) Date: Sep. 28, 2012

(87) PCT Pub. No.: WO2011/122479

PCT Pub. Date: Oct. 6, 2011

(65) Prior Publication Data

US 2013/0019390 A1 Jan. 24, 2013

(30) Foreign Application Priority Data

Mar. 30, 2010 (JP) ..... 2010-079078
Mar. 30, 2010 (JP) ..... 2010-079084
Mar. 30, 2010 (JP) ..... 2010-079157
Mar. 30, 2010 (JP) ..... 2010-079162

(51) Int. Cl.
*E03D 5/00* (2006.01)
*E03D 3/02* (2006.01)

(52) U.S. Cl.
CPC ..... *E03D 3/02* (2013.01)

(58) Field of Classification Search
CPC ..... E03D 3/02
USPC ..... 4/405, 422
See application file for complete search history.

(56) References Cited

U.S. PATENT DOCUMENTS 3,902,521 A * 9/1975 Keller et al. ..... 137/375

(Continued)

FOREIGN PATENT DOCUMENTS

JP H02-101181 U 8/1990
JP 2000-266276 A 9/2000
JP 2000-282537 A 10/2000

(Continued)

OTHER PUBLICATIONS

International Search Report; PCT/JP2011/057386; Mar. 25, 2011.

*Primary Examiner* — Janie Christiansen
(74) *Attorney, Agent, or Firm* — Studebaker & Brackett PC

(57) ABSTRACT

To provide a flow channel opening/closing apparatus that can keep the instantaneous flow rate of supply water, quickly open and close a main valve for starting and stopping water supply and be downsized. A flush valve CV, which is such a flow channel opening/closing apparatus, incorporates constant flow rate keeping part that operates to keep constant the main flow rate of water flowing from a primary-side internal flow channel 20 to a secondary-side internal flow channel 30, and the constant flow rate keeping part has a constant flow rate valve body 44 and a constant flow rate valve seat, operates to adjust the distance between the constant flow rate valve body 44 and the constant flow rate valve seat, and is configured as an integral valve member including a main valve body 42 and the constant flow rate valve body 44.

11 Claims, 19 Drawing Sheets

(56) References Cited

U.S. PATENT DOCUMENTS

| | | | | |
|---|---|---|---|---|
| 2004/0232370 | A1* | 11/2004 | Parsons et al. | 251/129.04 |
| 2005/0062004 | A1* | 3/2005 | Parsons et al. | 251/129.04 |
| 2011/0121213 | A1* | 5/2011 | Johnson et al. | 251/30.03 |

FOREIGN PATENT DOCUMENTS

| | | | |
|---|---|---|---|
| JP | 2003-278214 | A | 10/2003 |
| JP | 2004-019845 | A | 1/2004 |
| JP | 2006-170382 | A | 6/2006 |

* cited by examiner

FLOW CHANNEL OPENING/CLOSING APPARATUS

TECHNICAL FIELD

The present invention relates to a flow channel opening/closing apparatus that starts water supply to a toilet bowl in response to receiving an instruction to start water supply and autonomously stops water supply when a predetermined condition is met.

BACKGROUND ART

As known, a flush valve is such a flow channel opening/closing apparatus. The flush valve comprises a main body section having a flow inlet for receiving water from a primary-side flow channel, which is a water supply source, and feeding the water to a primary-side internal flow channel and a flow outlet for feeding water from a secondary-side internal flow channel to a secondary-side flow channel, which is a water supply destination, a main valve (a diaphragm valve) for opening and closing a flow channel between the primary-side internal flow channel and the secondary-side internal flow channel, a bypass flow channel that connects the primary-side internal flow channel and the secondary-side internal flow channel to each other without via the main valve, and a sub-valve (a relief valve) for opening and closing the bypass flow channel (see Patent Literature 1 listed below, for example).

With the flush valve configured as described above, when the sub-valve is opened by pushing down the operating lever, for example, the bypass flow channel is opened to decrease the back pressure on the main valve body of the main valve, the primary pressure in the primary-side internal flow channel pushes up the main valve body to separate the main valve body from the main valve seat, thereby opening the main valve, and water flows out to the secondary-side flow channel through the flow outlet. Then, when the sub-valve is closed by putting the operating lever back to the original position or automatically returns to the original position, the bypass flow channel is closed to increase the back pressure on the main valve body. The increased back pressure causes the main valve body to move downward and come closer to the main valve seat until the main valve body comes into contact with the main valve seat to close the main valve. In this way, the flush valve serves as a flow channel opening/closing apparatus that starts water supply to the toilet bowl in response to receiving an instruction to start water supply and autonomously stops water supply when a predetermined condition is met.

Conventional flush valves are quite useful apparatuses that feed approximately a predetermined amount of water with relatively simple structures and are widely used as means of supplying water to a urinal or toilet bowl. However, the conventional flush valves can hardly strictly control the amount of water because of their structures. Japanese Industrial Standards (JIS) prescribe that the normal water discharge amount is 15 L, the acceptable water discharge amount at low water pressure is 11 to 16.5 L, and the acceptable water discharge amount at high water pressure is 13.5 to 19 L.

As described above, with the conventional flush valves, the water discharge amount varies depending on the water pressure. In public spaces, for example, a plurality of toilet bowls is typically installed side by side, so that the water pressure can remarkably vary depending on the utilization of the toilet bowls. To overcome the problem, conventional flush valve type toilet bowls are configured to supply more water than required to ensure that feces are washed away even when the water pressure is low or the water pressure significantly varies. Thus, particularly in an environment where the water pressure is high or the water pressure less significantly varies, an unnecessarily increased amount of water has to be uselessly fed, and there was a demand for a solution to save water.

To solve the problem, there has been proposed a technique of incorporating a constant flow rate valve into the flush valve to keep the flow rate of water fed to the secondary-side flow channel constant even in an environment where the water pressure is high or even when the water pressure significantly varies in the primary-side flow channel, thereby reducing the waste of water and improving the water saving capability (see Patent Literature 2 listed below).

CITATION LIST

Patent Literature

[Patent Literature 1]
Japanese Patent Laid-Open No. 2006-170382
[Patent Literature 2]
Japanese Patent Laid-Open No. 2000-282537

SUMMARY OF INVENTION

Technical Problem

According to the conventional technique described in Patent Literature 2, a flush valve capable of operating without a constant flow rate valve incorporates a retrofitted constant flow rate valve. Each functional member of the conventional common flush valve requires, as a prerequisite, that the differential pressure between the primary pressure in the primary-side flow channel and the secondary pressure in the secondary-side flow channel is relatively large. If the constant flow rate valve is retrofitted, the differential pressure between the primary pressure and the secondary pressure decreases, so that the flow rate may be advantageously kept constant to some extent, but the opening/closing response of the main valve can deteriorate. In particular, in order to save water in the whole of the toilet bowl cleaning system including the flow channel opening/closing apparatus, the constant flow rate control is required to have higher reliability. Furthermore, in the case where the constant flow rate valve is retrofitted, of course, there is another problem that the entire apparatus is hard to downsize because the constant flow rate valve is added to the structure of the conventional common flush valve.

The present invention has been made in view of the problems described above, and an object of the present invention is to provide a flow channel opening/closing apparatus that starts water supply to a toilet bowl in response to receiving an instruction to start water supply and autonomously stops water supply when a predetermined condition is met, the flow channel opening/closing apparatus being capable of keeping the instantaneous flow rate of supply water, quickly opening and closing a main valve for starting and stopping water supply and being downsized.

Solution to Problem

In order to attain the object described above, a flow channel opening/closing apparatus according to the present invention is a flow channel opening/closing apparatus that starts water supply to a toilet bowl in response to receiving an instruction to start water supply and autonomously stops water supply when a predetermined condition is met. The flow channel opening/closing apparatus comprises: a main body part having an inlet for receiving water from a primary-side flow channel, which is a water supply source, and feeding water to a primary-side internal flow channel and an outlet for feeding water from a secondary-side internal flow channel to a secondary-side flow channel, which is a water supply destination; a main valve having a main valve body and a main valve seat that open and close a flow channel between the primary-side internal flow channel and the secondary-side internal flow channel; a bypass flow channel that connects the primary-side internal flow channel and the secondary-side internal flow channel to each other without via the main valve body and said main valve seat; a sub-valve that opens and closes the bypass flow channel; and delaying part that delays closing of the main valve by maintaining the main valve open until a back pressure on the main valve body increases to balance with a primary pressure in the primary-side internal flow channel, when the sub-valve is opened to decrease the back pressure on the main valve body to open the main valve, water flows from the primary-side internal flow channel to the secondary-side internal flow channel, and then the sub-valve is closed.

The main valve incorporates constant flow rate keeping part that operates to keep constant a main flow rate of water flowing from the primary-side internal flow channel to the secondary-side internal flow channel, and the constant flow rate keeping part has a constant flow rate valve body and a constant flow rate valve seat and operates to adjust the distance between the constant flow rate valve body and the constant flow rate valve seat.

The main valve body and the constant flow rate valve body are formed as an integral valve member. The main valve body is disposed closer to the inlet than the constant flow rate valve body. The main valve body moves in a direction to reduce the flow rate when the valve member is driven in a direction to cause the constant flow rate valve body to reduce the flow rate. The main valve has a spring disposed so as to apply to the main valve body a force that balances with a force applied by the primary pressure in the primary-side internal flow channel. The opening of the main valve body with respect to the main valve seat is adjusted in accordance with the primary pressure by the action of the spring.

With the flow channel opening/closing apparatus according to the present invention, the main valve incorporates the constant flow rate valve body and the constant flow rate valve seat, and the main flow rate of water flowing from primary-side internal flow channel to the secondary-side internal flow channel is kept constant by adjusting the distance between the constant flow rate valve body and the constant flow rate valve seat. Since the main valve body and the constant flow rate valve body are formed as the integral valve member, the main valve body and the constant flow rate valve body integrally moves when the valve member is driven. In this way, since the flow rate can also be adjusted by driving the main valve body, the differential pressure between the primary pressure and the secondary pressure can be increased, so that the main valve body can be quickly opened and closed. Thus, the flow channel opening/closing apparatus provided can quickly open and close the main valve for starting and stopping water supply and can be downsized.

The flow channel opening/closing apparatus can be used to supply water to a toilet bowl or the like that requires water supply at a relatively high instantaneous flow rate. In a situation where water flows from the primary-side internal flow channel to the secondary-side internal flow channel at such a high flow rate, it is extremely difficult to finely adjust the distance between the constant flow rate valve body and the constant flow rate valve seat. In view of this, the main valve body is disposed closer to the inlet than the constant flow rate valve body so that the water having passed through the main valve body and the main valve seat is supplied to the constant flow rate valve body, thereby reducing the influence of the water pressure variation on the constant flow rate valve body. Furthermore, since the main valve body moves in the direction to reduce the flow rate when the valve member is driven in the direction to cause the constant flow rate valve body to reduce the flow rate, the flow channel from the primary-side internal flow channel to the constant flow rate valve body can be additionally narrowed, so that the influence of the water pressure variation on the constant flow rate valve body can be readily and effectively reduced.

Preferably, the main valve has a position controlling member that moves in a direction of sliding of the integral valve member comprising the main valve body and the constant flow rate valve body to adjust the range of movement of the valve member. Preferably, the spring adjusts the position of the position controlling member by applying to the position controlling member a force that balances with the force applied by the primary pressure and produces a greater repulsive force when the position controlling member moves in a direction to reduce the range of movement of the valve member. Preferably, the valve member and the position controlling member are separate from each other when the main valve body and the main valve seat abut against each other to close the flow channel between the primary-side internal flow channel and the secondary-side internal flow channel.

Since the main valve has the position controlling member that moves in the direction of sliding of the valve member to adjust the range of movement of the valve member and the spring that adjusts the position of the position controlling member by applying to the position controlling member a force that balances with the force applied by the primary pressure, the position of the position controlling member and the range of movement of the valve member can be adjusted to achieve a constant flow rate with a simple arrangement including the spring. Since the spring is configured to produce a greater repulsive force when the position controlling member moves in the direction to reduce the range of movement of the valve member, the valve member and the position controlling member are disposed spaced apart from each other to stop water supply with reliability even when the primary pressure is low. Since the valve member and the position controlling member are disposed spaced apart from each other when the main valve body and the main valve seat abut against each other to close the flow channel between the primary-side internal flow channel and the secondary-side internal flow channel to stop water supply, the flow rate can be kept constant and the water supply can be stopped with reliability with a simple arrangement including the spring and the position controlling member.

Preferably, when the main valve and the sub-valve are closed, the position controlling member is kept at a farthest position from the valve member in the range of movement of the position controlling member by the repulsive force of the spring.

The flow channel opening/closing apparatus according to the present invention is required to quickly separate the main valve from the main valve seat to supply a flow of water at a certain level of flow rate to the downstream side when the sub-valve is opened to feed water. Therefore, it is necessary to eliminate any element that hinders the movement of the main valve when the sub-valve is opened. To this end, the position controlling member is kept at the farthest position from the valve member during a waiting state in which the main valve and the sub-valve are closed, thereby reducing the possibility that the movement of the valve member is hindered even when the position controlling member moves toward the valve member. Thus, the position controlling member does not hinder the movement of the main valve in the valve member, and the main valve can quickly separate from the main valve seat.

Preferably, the delaying part has a back pressure chamber that accumulates water flowing into the back pressure chamber from the primary-side internal flow channel and is configured to apply the primary pressure in a direction to push the main valve body toward the main valve seat. Preferably, a sub-back pressure chamber that applies a back pressure to push the position controlling member toward the valve member is provided on the opposite side of the position controlling member to the main valve, and a sub-primary flow channel that connects the primary-side internal flow channel and the sub-back pressure chamber to each other is provided.

Since the sub-back pressure chamber that applies a back pressure to push the position controlling member toward the valve member is provided, and the sub-primary flow channel that connects the primary-side internal flow channel and the sub-back pressure chamber to each other is provided, the primary pressure can be instantaneously applied to the sub-back pressure chamber to push the position controlling member toward the valve member in response to a decrease of the water pressure in the back pressure chamber. Therefore, compared with an arrangement that involves activating an actuator in response to a pressure sensor or a variation of the internal pressure detected by the pressure sensor, the position controlling member can be quickly moved to a predetermined position.

Preferably, pulsation reducing part that reduces a pulsation of the valve member caused by a pulsation of the primary pressure is provided. Since the pulsation reducing part is provided, the valve member can stably remain at a predetermined position even when water flows at a relatively high flow rate. Therefore, the distance between the constant flow rate valve body and the constant flow rate valve seat is also not influenced by the pulsation of the primary pressure, and a pulsation of the flow rate can be prevented.

Preferably, the valve member has a pressure receiving surface that receives the primary pressure and is configured to be capable of moving back and forth in response to the pressure applied to the pressure receiving surface. Preferably, as the pulsation reducing part, an attenuation mechanism that attenuates a pulsation of the primary pressure is provided in a flow channel from the primary-side internal flow channel to the pressure receiving surface by reducing the cross-sectional area of the flow channel.

According to this preferred aspect, since the valve member has the pressure receiving surface that receives the primary pressure in the primary-side internal flow channel and is configured to be capable of moving back and forth in response to the pressure applied to the pressure receiving surface, the valve member can be kept at a predetermined position with reliability by controlling the pressure applied to the pressure receiving surface. Since the attenuation mechanism that attenuates a pulsation of the primary pressure is provided in the flow channel from the primary-side internal flow channel to the pressure receiving surface by reducing the cross-sectional area of the flow channel, the influence of the pressure variation on the pressure receiving surface can be minimized simply by narrowing the flow channel.

Preferably, the spring is disposed so as to apply to the main valve body a force that balances with the force applied by the primary pressure in the primary-side internal flow channel, and the opening of the main valve body with respect to the main valve seat is adjusted in accordance with the primary pressure by the action of the spring. Preferably, the spring is disposed in a back pressure chamber which, at least when the sub-valve is closed, does not permit water flowing from the primary-side internal flow channel to the secondary-side internal flow channel to pass therethrough but accumulates water flowing into the back pressure chamber from the primary-side internal flow channel and applies the primary pressure in a direction to push the main valve body toward the main valve seat.

According to this preferred aspect, since the spring is disposed in the back pressure chamber which, at least when the sub-valve is closed, does not permit water flowing from the primary-side internal flow channel to the secondary-side internal flow channel to pass therethrough, the spring is not influenced by the flow, and the influence of any pulsation of the flow on the position control of the main valve body can be reduced with reliability.

Preferably, the spring is configured so that the relationship between the applied load and the displacement has a linear characteristic. On the other hand, the constant flow rate valve body has such an outer shape that the relationship between the displacement of the valve member and the main flow rate has a non-linear characteristic.

If the flow rate is adjusted with a valve comprising a valve seat and a valve body that come into contact with each other in a plane, the relationship between the distance between the valve seat and the valve body and the water pressure has a non-linear characteristic: as the distance increases, the decrement of the water pressure increases. If a spring that exhibits a linear relationship between the applied load and the displacement is used as in this preferred aspect, the arrangement is simple, but the forces balance with each other at fewer points since the valve has a non-linear characteristic, and the main flow rate varies. Thus, in this preferred aspect, the outer shape of the constant flow rate valve body is designed so that the relationship between the displacement of the valve member and the main flow rate has a non-linear characteristic, and as a result, the relationship between the distance between the constant flow rate valve body and the constant flow rate valve seat and the water pressure has a linear characteristic, thereby preventing the main flow rate from varying even if the spring having a linear characteristic is used.

Preferably, the valve member slides to make the main valve body abut against and separate from the main valve seat, and stabilizing part that prevents inclination of the valve member is provided to prevent the valve member from rubbing against a surrounding inner wall of the main body part and thereby being hindered from sliding smoothly.

Since the stabilizing part that prevents inclination of the valve member is provided, the valve member can stably slide even when water flows at a relatively high flow rate. Therefore, the valve member can be prevented from rubbing against the surrounding inner wall of the main body part and thereby being hindered from sliding smoothly, and the flow rate control can be stably achieved.

Preferably, the stabilizing part is a part of the valve member that serves as a guide part and comes into contact with a part of the main body part, thereby allowing the valve member to slide without being inclined.

According to this preferred aspect, since a part of the valve member comes into contact with a part of the main body part and serves as a guide part, the valve member can slide without being inclined. Therefore, the valve member can be made to stably slide without being inclined simply by using a part of the valve member as a guide part, and the flow rate control can be stably achieved.

Preferably, the stabilizing part is a part of the valve member that serves as a guide part and comes into contact with a part of the primary-side internal flow channel and the secondary-side internal flow channel, thereby allowing the valve member to slide without being inclined.

According to this preferred aspect, a part of the valve member comes into contact with a part of the primary-side internal flow channel and the secondary-side internal flow channel and serves as a guide part. The water flowing in the primary-side internal flow channel and the secondary-side internal flow channel tends to cause an inclination of the valve member when the flow rate is high. The guide part is provided at a part of the flow channel that is most likely to receive the force that causes the inclination, thereby assuring that the valve member can slide without being inclined. Therefore, the valve member can be made to stably slide without being inclined with reliability simply by using a part of the valve member as a guide part, and the flow rate control can be stably achieved.

Any appropriate combinations of some or all of the elements described above are included in the scope of the present invention claimed by this application.

Advantageous Effects of Invention

According to the present invention, there is provided a flow channel opening/closing apparatus that starts water supply to a toilet bowl in response to receiving an instruction to start water supply and autonomously stops water supply when a predetermined condition is met, the flow channel opening/closing apparatus being capable of keeping the instantaneous flow rate of supply water, quickly opening and closing a main valve for starting and stopping water supply and being downsized.

DESCRIPTION OF EMBODIMENTS

Figure 1:
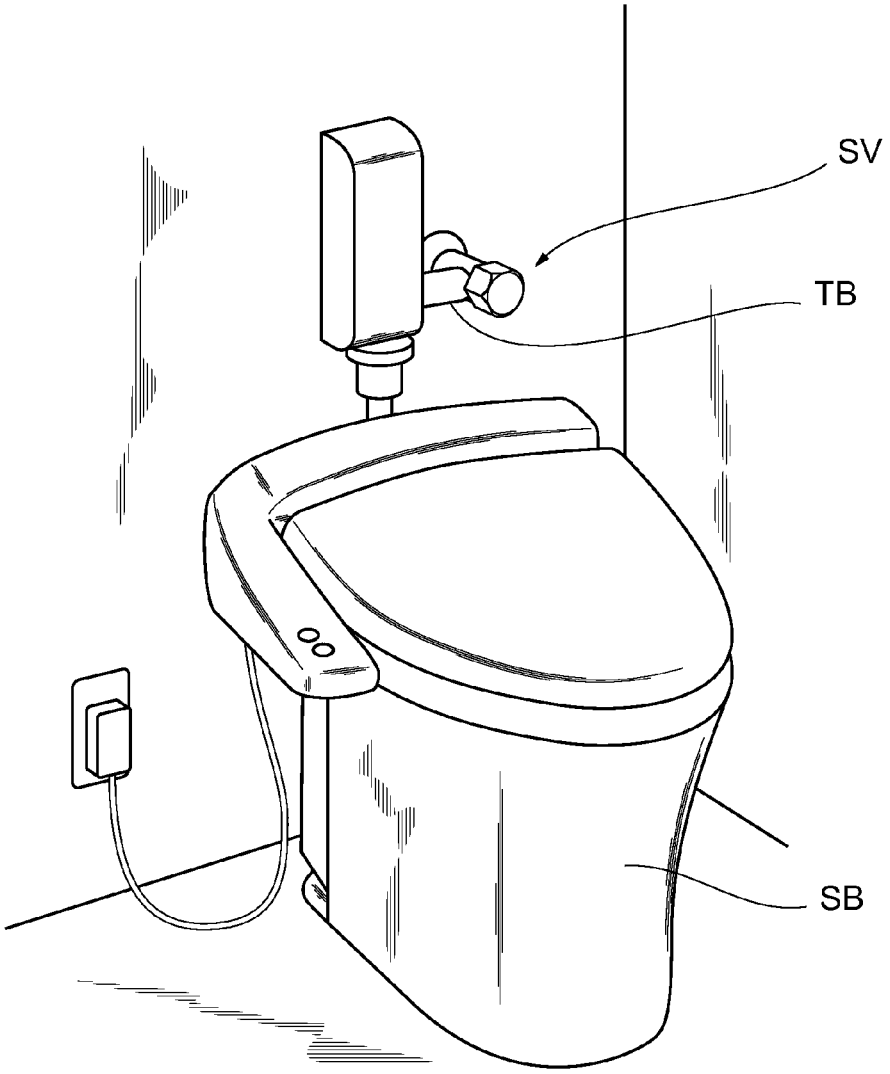
FIG. 1 is an outside view of a flush valve according to an embodiment of the present invention attached to a water supply pipe to a toilet bowl.

In the following, embodiments of the present invention will be described with reference to the accompanying drawings. To facilitate understanding of the description, the same components are denoted by the same reference numerals throughout the drawings as far as possible, and redundant descriptions will be omitted.

FIG. 1 shows a flush valve (a flow channel opening/closing apparatus) according to an embodiment of the present invention. FIG. 1 is an outside view of the flush valve according to the embodiment of the present invention attached to a water supply pipe to a toilet bowl. As shown in FIG. 1, the flush valve SV (the flow channel opening/closing apparatus) is attached to the water supply pipe TB to the toilet bowl SB at a middle position thereof. In response to receiving an instruction to start water supply, the flush valve SV opens a flow channel including the water supply pipe TB to start water supply to the toilet bowl SB. Then, when a predetermined condition (which will be described in detail later) is met, the flush valve SV autonomously closes the flow channel to stop water supply.

Figure 2:
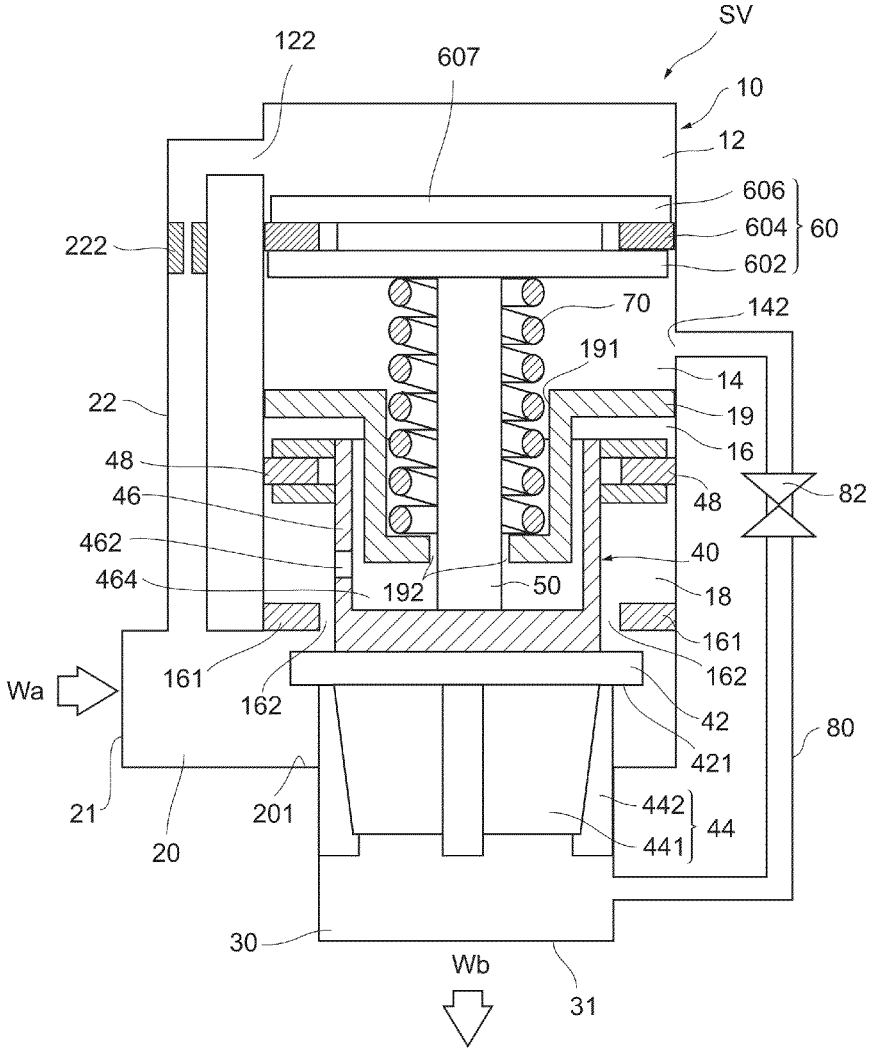
FIG. 2 is a schematic diagram showing an internal structure of the flush valve according to a first embodiment of the present invention.

Next, with reference to FIG. 2, an internal structure of a flush valve SV according to a first embodiment of the present invention will be described. FIG. 2 is a schematic diagram showing the internal structure of the flush valve SV.

As shown in FIG. 2, the flush valve SV has a main body part 10. In the main body part 10, a primary-side internal flow channel 20, a secondary-side internal flow channel 30, a first back pressure chamber 16 (a back pressure chamber), a second back pressure chamber 14 (a back pressure chamber) and a sub-back pressure chamber 12 are formed. The primary-side internal flow channel 20 receives influent water Wa from a primary-side flow channel (a flow channel upstream of the flush valve SV on the water supply pipe TB shown in FIG. 1), which is a water supply source, and feeds the water to the secondary-side internal flow channel 30. An inlet 21 is provided at an upstream end of the primary-side internal flow channel 20. The inlet 21 is an opening for receiving the influent water Wa and feeding the water to the primary-side internal flow channel 20.

The secondary-side internal flow channel 30 feeds influent water from the primary-side internal flow channel 20 to a secondary-side flow channel (a flow channel downstream of the flush valve SV on the water supply pipe TB shown in FIG. 1), which is a water supply destination, as effluent water Wb. An outlet 31 is provided at a downstream end of the secondary-side internal flow channel 30. The outlet 31 is an opening for feeding the effluent water Wb from the secondary-side internal flow channel 30 to the secondary-side flow channel.

A valve member 40 having a main valve body 42 that opens and closes the flow channel between the primary-side internal flow channel 20 and the secondary-side internal flow channel 30 is disposed between the primary-side internal flow channel 20 and the secondary-side internal flow channel 30. One end of the valve member 40 on the downstream side is inserted into the secondary-side internal flow channel 30, and the opposite end faces the second back pressure chamber 14. The valve member 40 is disposed so as to be capable of moving back and forth in the direction of extension of the secondary-side internal flow channel 30.

A surface of the main valve body 42 on the downstream side forms a main valve body surface 421. When the valve member 40 is pushed to the downstream limit, the main valve body surface 421 abuts against a boundary surface of the primary-side internal flow channel 20 to the secondary-side internal flow channel 30, thereby blocking the flow of water between the primary-side internal flow channel 20 and the secondary-side internal flow channel 30. Thus, the boundary surface against which the main valve body surface 421 abuts functions as a main valve seat surface 201 (a main valve seat).

A constant flow rate valve body 44 (constant flow rate keeping part) is provided on the valve member 40 in a part downstream of the main valve body 42. The constant flow rate valve body 44 has an inclined surface 441 (an outer surface) and a valve side protrusion 442 (a guide part or stabilizing part). The valve side protrusion 442 is provided to abut against the side wall of the secondary-side internal flow channel 30. A plurality of valve side protrusions 442 is provided along the perimeter of the flow channel so as to abut against the inner side wall of the secondary-side internal flow channel 30 having an approximately circular cross section at different positions. Since the valve side protrusions 442 abut against the inner side wall of the secondary-side internal flow channel 30 when the valve member 40 slides back and forth, the valve member 40 can stably slide without being inclined.

Since the distance between the inclined surface 441 of the constant flow rate valve body 44 and the inner side wall of the secondary-side internal flow channel 30 is variable, the inner side wall of the secondary-side internal flow channel 30 serves as a constant flow rate valve seat for the constant flow rate valve. The inclined surface 441 is formed inclined so as to deviate from the inner side wall of the secondary-side internal flow channel 30 as it goes from the main valve body 42 toward the outlet 31.

Consequently, when the valve member 40 moves upward (in the direction to enter the first back pressure chamber 16) so as to allow water to pass through between the primary-side internal flow channel 20 and the secondary-side internal flow channel 30, the minimum distance between the inclined surface 441 of the constant flow rate valve body 44 and the inner side wall of the secondary-side internal flow channel 30 increases, so that the flow rate of water increases. If the valve member 40 once moving upward (in the direction to enter the first back pressure chamber 16) so as to allow water to pass through between the primary-side internal flow channel 20 and the secondary-side internal flow channel 30 then moves downward (in the direction toward the outlet 31), the minimum distance between the inclined surface 441 of the constant flow rate valve body 44 and the inner side wall of the secondary-side internal flow channel 30 decreases, so that the flow rate of water decreases.

The valve member 40 has a housing hollow part 46 provided on the opposite side of the main valve body 42 to the constant flow rate valve body 44. The housing hollow part 46 has the shape of a recess that retreats from the first back pressure chamber 16. A C-ring 48 is provided at an end of the housing hollow part 46 closer to the first back pressure chamber 16. The C-ring 48 is disposed so as to abut against the inner side wall of the main body part 10 in a part closer to the secondary-side internal flow channel 30 than the first back pressure chamber 16.

As described above, the valve side protrusions 442 abut against the inner side wall of the secondary-side internal flow channel 30 at one end of the valve member 40, and the C-ring 48 abuts against the inner side wall of the main body part 10 at the other end of the valve member 40. Thus, the valve member 40 is designed to slide with its opposite ends held so as to prevent inclination of the valve member 40.

A narrowed part 161 is formed on the inner side wall of the main body part 10 so as to protrude therefrom in a part between the C-ring 48 and the main valve body 42. A gap, which serves as a narrowed flow channel 162, is formed between the narrowed part 161 and the housing hollow part 46. Thus, water flows from the primary-side internal flow channel 20 into an intermediate chamber 18, which is defined between the housing hollow part 46 and the inner side wall of the main body part 10, at a speed reduced by the narrowed flow channel 162.

The housing hollow part 46 has a hole 462 that connects the intermediate chamber 18 and the first back pressure chamber 16 to each other. Therefore, the water flowing from the primary-side internal flow channel 20 into the intermediate chamber 18 flows into the first back pressure chamber 16 through the hole 462.

The first back pressure chamber 16 and the second back pressure chamber 14 are separated by a partition wall 19. The partition wall 19 has a hollow part 191. The hollow part 191 has the shape of a recess whose outer wall protrudes from the second back pressure chamber 14 into the first back pressure chamber 16. A spring 70 (constant flow rate keeping part) having a linear characteristic is disposed on the same side of the hollow part 191 as the second back pressure chamber 14. The spring 70 is housed in the hollow part 191 at one end and abuts, at the other end, against a wall member 60 that separates the sub-back pressure chamber 12 and the second back pressure chamber 14 from each other.

A bottom surface (a surface protruding most into the first back pressure chamber 16) of the hollow part 191 is shaped to allow a rod-shaped position controlling member 50 to pass therethrough, and a gap is formed between the bottom surface of the hollow part 191 and the position controlling member 50 to provide a narrowed part 192. Thus, water flowing into the intermediate chamber 18 from the primary-side internal flow channel 20 flows into the first back pressure chamber 16 through the hole 462 and then flows into the second back pressure chamber 14 through the narrowed part 192.

The position controlling member 50 is disposed so as to pass through the center of the windings of the spring 70. The position controlling member 50 is disposed so as to abut against or separate from the bottom surface of the housing hollow part 46 of the valve member 40 at one end and fixed to the wall member 60 at the other end.

The housing hollow part 46 is configured to house the hollow part 191 of the partition wall 19 when the valve member 40 comes close to the partition wall 19. A space 464 is provided between the housing hollow part 46 and the hollow part 191 and filled with water to dampen the movement of the housing hollow part 46 with respect to the hollow part 191, thereby stabilizing the movement of the valve member 40.

The wall member 60 has a lower wall member 602, a C-ring 604 and an upper wall member 606. The lower wall member 602 is a wall that faces the second back pressure chamber 14. The upper wall member 606 is a wall that faces the sub-back pressure chamber 12. The C-ring 604 is held between the lower wall member 602 and the upper wall member 606. The C-ring 604 is disposed in close contact with the inner side wall of the main body part 10 in a part between the sub-back pressure chamber 12 and the second back pressure chamber 14. The C-ring 604 is a C-shaped member that is not fixed at any of both ends and is made of a resin or the like so that air or the like can pass through between both the ends depending on the pressure or other conditions.

The wall member 60 is configured to slide so as to expand the sub-back pressure chamber 12 (narrow the second back pressure chamber 14) or narrow the sub-back pressure chamber 12 (expand the second back pressure chamber 14) depending on the pressure difference between the sub-back pressure chamber 12 and the second back pressure chamber 14. Since the position controlling member 50 is fixed to the lower wall member 602 of the wall member 60, the position controlling member 50 moves when the wall member 60 slides.

The pressure applied to the sub-back pressure chamber 12 is equal to a primary pressure applied to the primary-side internal flow channel 20. More specifically, the primary-side internal flow channel 20 and the sub-back pressure chamber 12 are connected to each other by a sub-primary flow channel 22, and the primary pressure is exerted also to the sub-back pressure chamber 12. A narrowed part 222 (pulsation reducing part or an attenuation mechanism) for reducing the cross sectional area of the sub-primary flow channel 22 is provided in the middle of the sub-primary flow channel 22. The sub-primary flow channel 22 is connected to the sub-back pressure chamber 12 by a hole 122 formed in the side wall of the sub-back pressure chamber 12. Therefore, a surface of the wall member 60 closer to the sub-back pressure chamber 12 functions as a pressure receiving surface 607 that receives the primary pressure.

The second back pressure chamber 14 and the secondary-side internal flow channel 30 are connected to each other by a bypass flow channel 80. A sub-valve 82 is provided on the bypass flow channel 80. If the sub-valve 82 is closed, and the first back pressure chamber 16 and the second back pressure chamber 14 are filled with water, the primary pressure is applied in the first back pressure chamber 16 and the second back pressure chamber 14. If the sub-valve 82 is opened, the water in the first back pressure chamber 16 and the second back pressure chamber 14 flows to the secondary-side internal flow channel 30 through the bypass flow channel 80, and the internal pressure of the first back pressure chamber 16 and the second back pressure chamber 14 decreases.

Figure 3C:
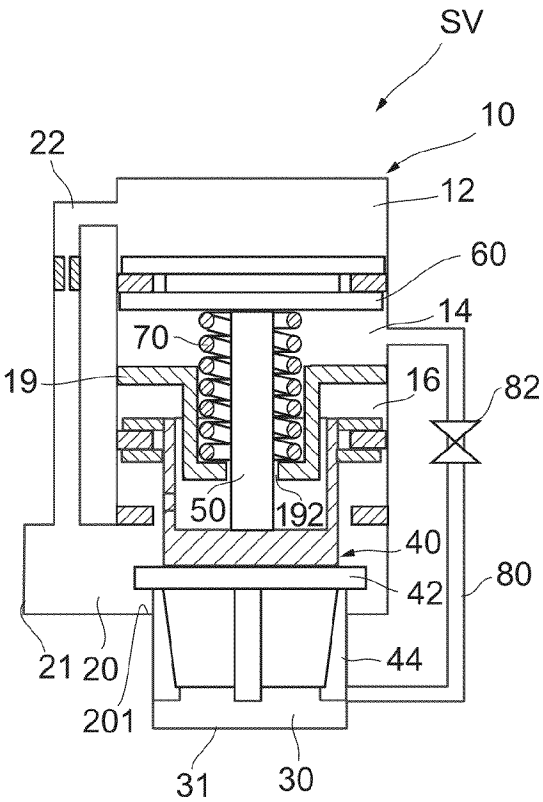
FIG. 3 includes diagrams for illustrating a water discharge operation of the flush valve shown in FIG. 2.
Figure 3B:
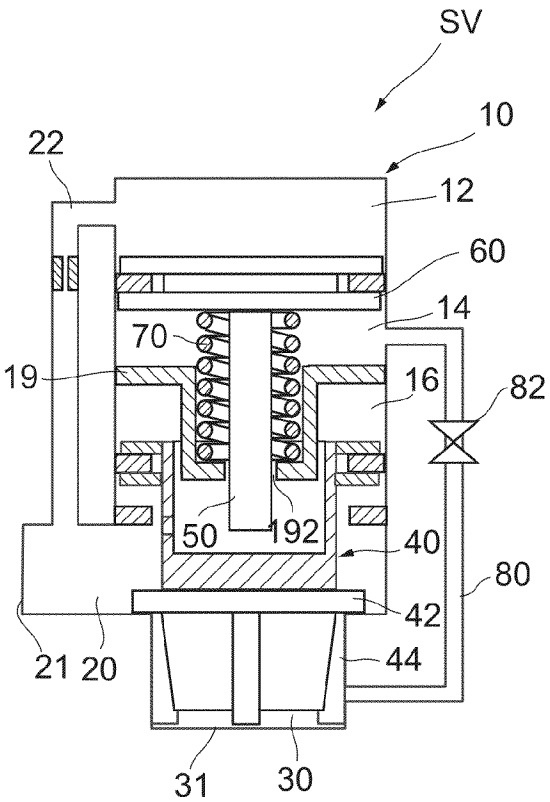
Figure 3A:
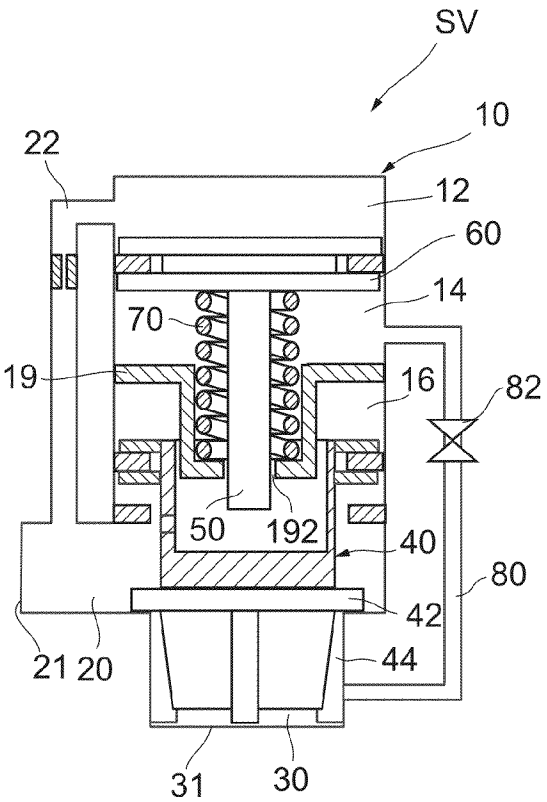

Next, an operation of the flush valve SV will be described with reference to FIG. 3. FIG. 3 includes diagrams for illustrating a water discharge operation of the flush valve SV shown in FIG. 2. FIG. 3(*a*) shows a state of the flush valve SV before water discharge, FIG. 3(*b*) shows a state of the flush valve SV with the sub-valve 82 opened, and FIG. 3(*c*) shows a state of the flush valve SV during water discharge while the flow rate of water is adjusted.

As shown in FIG. 3(*a*), when the sub-valve 82 is closed, the same primary pressure as the primary pressure applied to the primary-side internal flow channel 20 is applied also to the first back pressure chamber 16, the second back pressure chamber 14 and the sub-back pressure chamber 12. The main valve body 42 of the valve member 40 is pushed toward the outlet 31 by the primary pressure to come into close contact with the boundary surface of the primary-side internal flow channel 20 to the secondary-side internal flow channel 30, thereby stopping water supply.

Then, as shown in FIG. 3(*b*), when the sub-valve 82 is opened, the water in the second back pressure chamber 14 first flows out. This is because circulation of water between the second back pressure chamber 14 and the first back pressure chamber 16 occurs through the narrowed part 192. Since the narrowed part 192 is a narrow gap, the speed of the water flowing through the bypass flow channel 80 is higher than the speed of the water flowing out of the first back pressure chamber 16, so that the water flowing from the first back pressure chamber 16 into the second back pressure chamber 14 lags.

If the water in the second back pressure chamber 14 flows out, the pressure in the second back pressure chamber 14 decreases. As a result, a pressure difference occurs between the second back pressure chamber 14 and the sub-back pressure chamber 12 occurs, and thus, the wall member 60 is pressed downward. Since the wall member 60 and the position controlling member 50 are fixed to each other, the position controlling member 50 is also pressed downward. Since the spring 70 is disposed between the wall member 60 and the partition wall 19, when the wall member 60 is pressed downward, the spring 70 shrinks and produces a repulsive force. How far the wall member 60 and the position controlling member 50 come close to the valve member 40 depends on the balance between the primary pressure pushing the wall member 60 and the repulsive force of the spring 70.

If the wall member 60 and the position controlling member 50 are pushed downward toward the valve member 40 as described above, as shown in FIG. 3(*c*), the water in the first back pressure chamber 16 also flows out, and the valve member 40 is pushed upward toward the first back pressure chamber 16 and the second back pressure chamber 14. The main valve body 42 (the main valve body surface 421) of the valve member 40 separates from the main valve seat surface 201, so that water flows from the primary-side internal flow channel 20 into the secondary-side internal flow channel 30. The flow rate of the water flowing from the primary-side internal flow channel 20 into the secondary-side internal flow channel 30 is adjusted by the width of the gap between the constant flow rate valve body 44 and the secondary-side internal flow channel 30.

Then, when the sub-valve 82 is closed, water flows into the first back pressure chamber 16 and the second back pressure chamber 14 through the narrowed flow channel 162 (see FIG. 2), the hole 462 (see FIG. 2) and the narrowed part 192 (see FIG. 2) until the first back pressure chamber 16 and the second back pressure chamber 14 are filled with water, and as a result, the primary pressure is applied to push the valve member 40 downward until the main valve body 42 (the main valve body surface 421) abuts against the main valve seat surface 201 to stop water supply.

Figure 4:
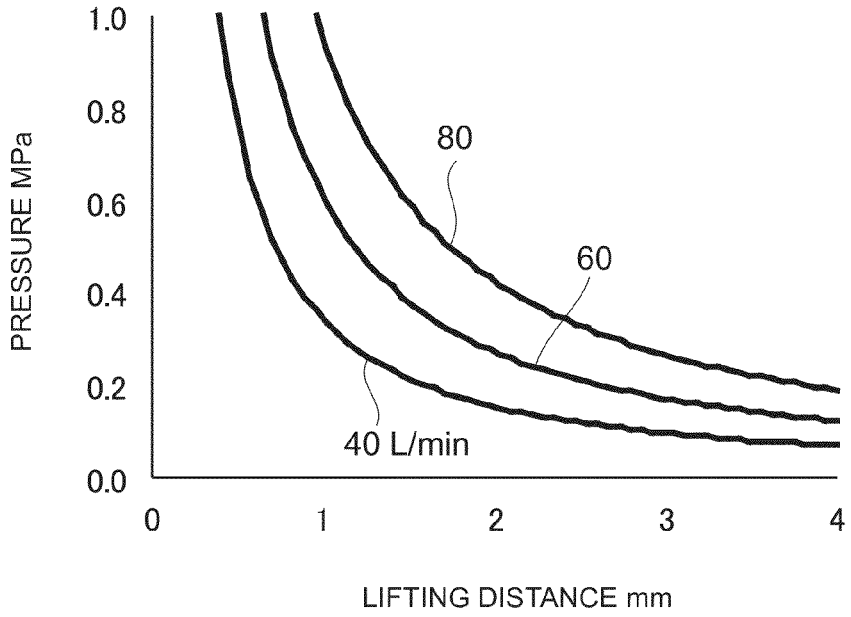
FIG. 4 is a graph showing relationships between the lifting distance of a spring and the water pressure of a conventional flow rate adjusting valve body in cases where water is supplied at constant flow rates.
Figure 5:
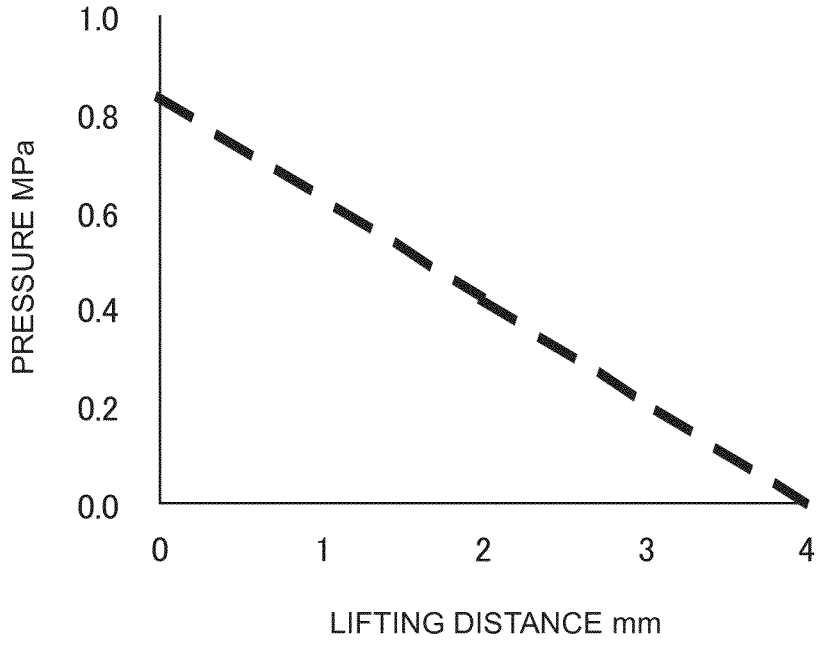
FIG. 5 is a graph showing a relationship between the lifting distance (the amount of expansion or shrinkage) and the water pressure in a case where a water pressure is applied to the spring.
Figure 6:
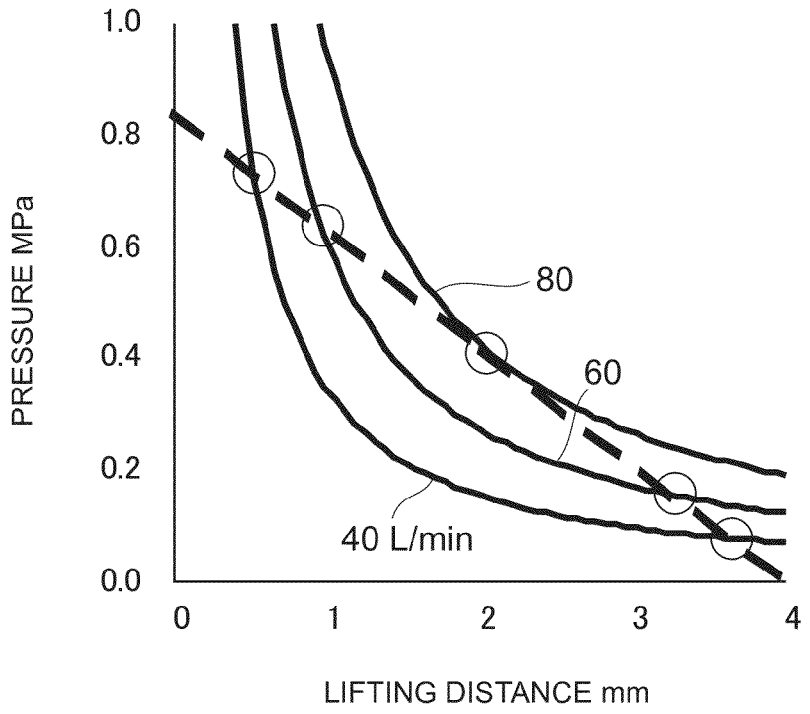
FIG. 6 is a graph for illustrating points where the force of a flow rate adjusting valve body having the characteristic shown in FIG. 4 to open and the force of the spring having the characteristic shown in FIG. 5 to bear the force of the flow rate adjusting valve body balance with each other.
Figure 7:
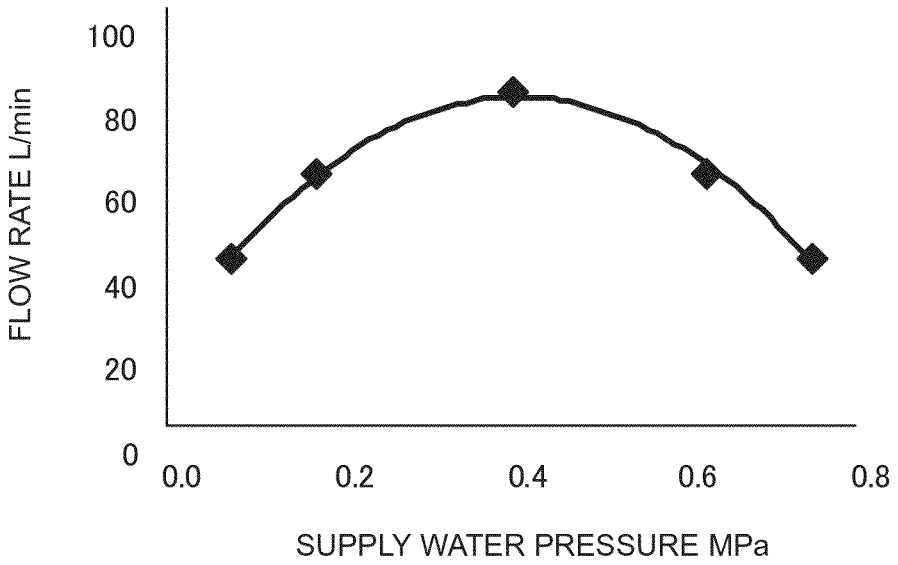
FIG. 7 is a graph showing a relationship between the supply water pressure and the water amount in the case where the spring having the characteristic shown in FIG. 5 bears the force of the flow rate adjusting valve body having the characteristic shown in FIG. 4 to open.
Figure 8A:
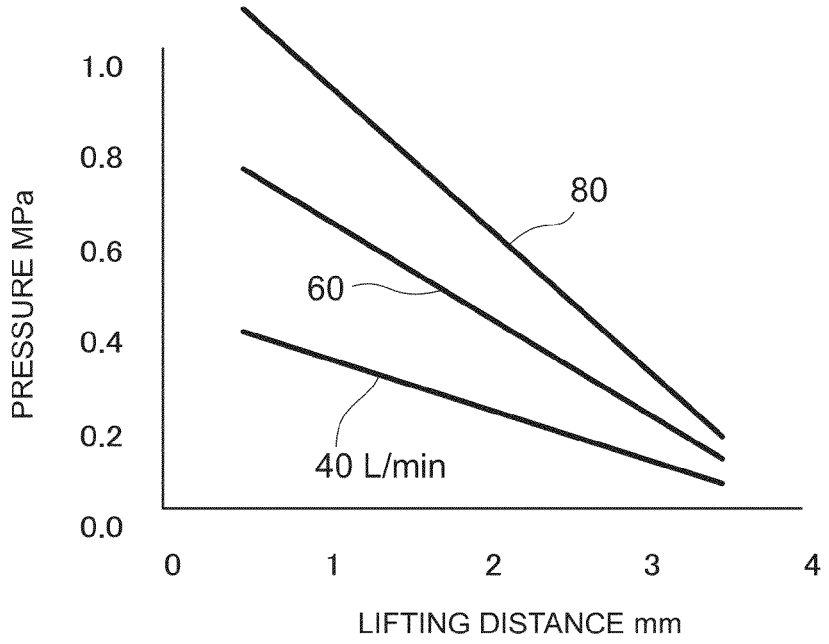
FIG. 8 includes graphs showing relationships between the lifting distance and the water pressure in a case where a constant flow rate valve body according to this embodiment passes water at constant flow rates.
Figure 8B:
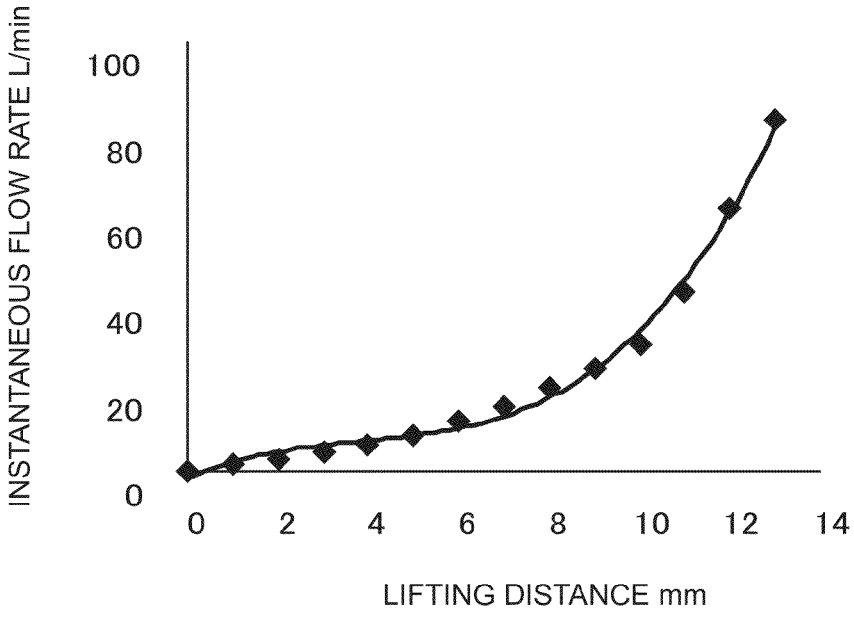
Figure 9:
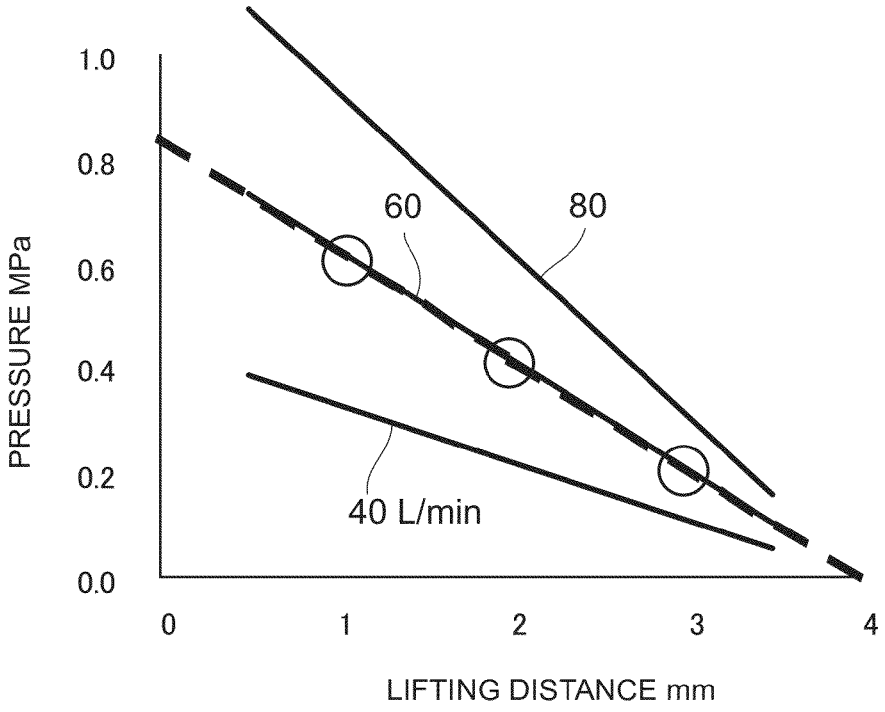
FIG. 9 is a graph for illustrating points where the force of the constant flow rate valve body having the characteristic shown in FIG. 8 to open and the force of the spring having the characteristic shown in FIG. 5 to bear the force of the constant flow rate valve body balance with each other.
Figure 10:
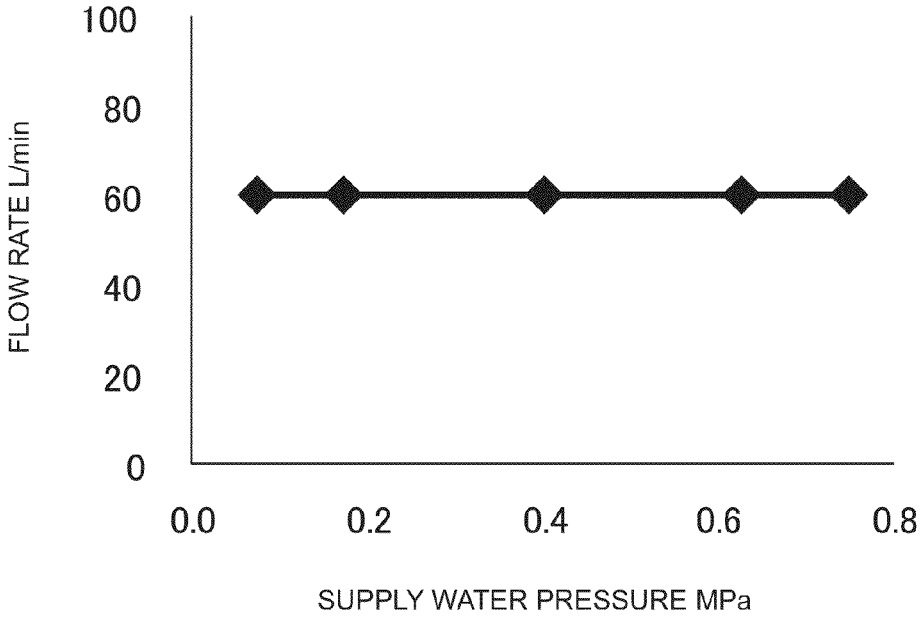
FIG. 10 is a graph showing a relationship between the supply water pressure and the water amount in the case where the spring having the characteristic shown in FIG. 5 bears the force of the constant flow rate valve body having the characteristic shown in FIG. 8 to open.
Figure 11:
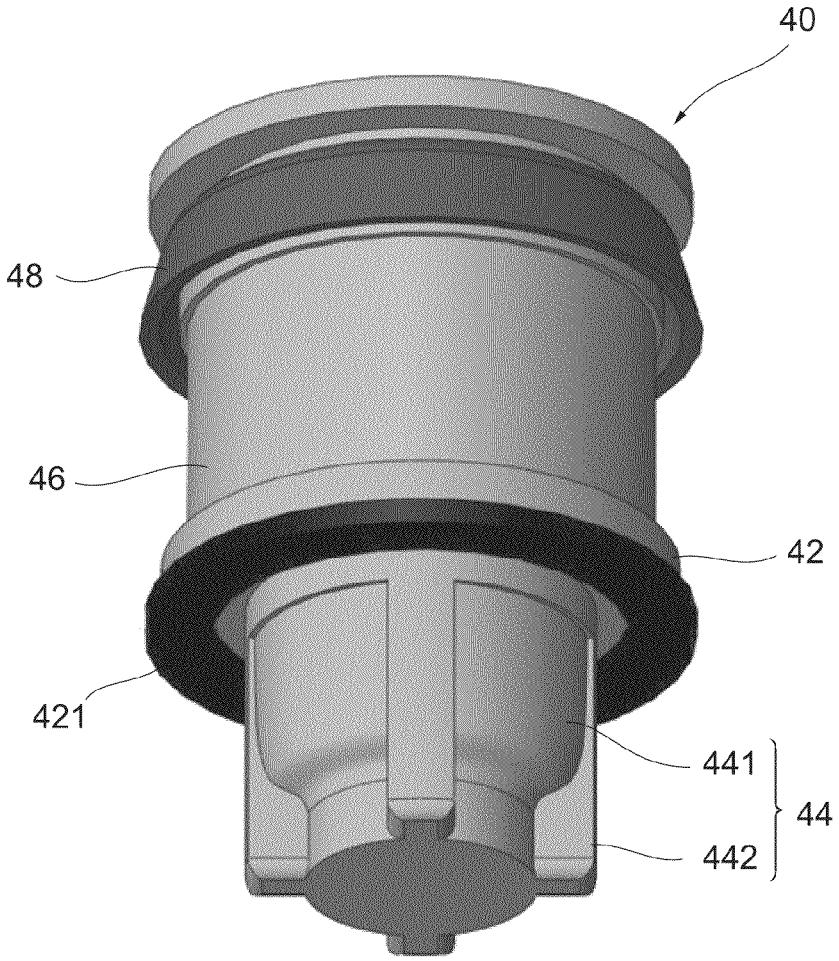
FIG. 11 is a perspective view showing an example of the constant flow rate valve body having the characteristic shown in FIG. 8.

With the flush valve SV according to this embodiment, the design of the constant flow rate valve body 44 allows the constant flow rate control to be readily performed. The advantages of the design of the constant flow rate valve body 44 will be described with reference to FIGS. 4 to 11. FIG. 4 is a graph showing relationships between the lifting distance and the water pressure of a conventional flow rate adjusting valve body in cases where water is supplied at constant flow rates. FIG. 5 is a graph showing a relationship between the lifting distance (the amount of expansion or shrinkage) and the water pressure in a case where a water pressure is applied to the spring. FIG. 6 is a graph for illustrating points where the force of a flow rate adjusting valve body having the characteristic shown in FIG. 4 to open and the force of the spring having the characteristic shown in FIG. 5 to bear the force of the flow rate adjusting valve body balance with each other. FIG. 7 is a graph showing a relationship between the supply water pressure and the water amount in the case where the spring having the characteristic shown in FIG. 5 bears the force of the flow rate adjusting valve body having the characteristic shown in FIG. 4 to open. FIG. 8 includes graphs showing relationships between the lifting distance and the water pressure in a case where the constant flow rate valve body according to this embodiment passes water at constant flow rates. FIG. 9 is a graph for illustrating points where the force of the constant flow rate valve body having the characteristic shown in FIG. 8 to open and the force of the spring having the characteristic shown in FIG. 5 to bear the force of the constant flow rate valve body balance with each other. FIG. 10 is a graph showing a relationship between the supply water pressure and the water amount in the case where the spring having the characteristic shown in FIG. 5 bears the force of the constant flow rate valve body having the characteristic shown in FIG. 8 to open. FIG. 11 is a perspective view showing an example of the constant flow rate valve body having the characteristic shown in FIG. 8.

As a comparative example, a conventional flow rate adjusting valve body that adjusts the flow rate with a valve having a water stopping capability (a valve having a configuration corresponding to the main valve body 42 and the main valve seat surface 201 according to this embodiment) is used. Such a valve having a water stopping capability comprises a flat seat surface and a flat valve body that moves with respect to the seat surface and adjusts the flow rate of water flowing between the seat surface and the valve body kept parallel with each other. In the case where such a flow rate adjusting valve body is used, the relationships between the lifting distance and the water pressure for keeping the flow rate at 40 L/min, 60 L/min and 80 L/min have non-linear characteristics as shown in FIG. 4. To the contrary, in the case where the spring having a normal linear characteristic is used, the relationship between the water pressure applied to the spring and the lifting distance (the amount of expansion or shrinkage) has a linear characteristic as shown in FIG. 5.

If the conventional flow rate adjusting valve having the characteristic shown in FIG. 4 and the spring having the characteristic shown in FIG. 5 are used and disposed so that the spring produces a force that resists the force of the flow rate adjusting valve to open, the forces balance with each other at points shown in FIG. 6, which are intersections of the characteristics shown in FIGS. 4 and 5. Thus, if the supply water pressure varies, the flow rate also varies, so that the constant flow rate control cannot be achieved as shown in FIG. 7.

To the contrary, the constant flow rate valve body 44 according to this embodiment has the characteristic shown in FIG. 8 that is intended for the force of the valve to open and the force of the spring having the characteristic shown in FIG. 5 to balance with each other at more points. FIG. 8(*a*) shows relationships between the lifting distance and the water pressure for maintaining the flow rate at 40 L/min, 60 L/min and 80 L/min in the case where the constant flow rate valve body 44 is used. As shown in FIG. 8(*a*), the relationship between the lifting distance and the water pressure has a linear characteristic for each flow rate. This characteristic can be reduced into a relationship between the lifting distance and the instantaneous flow rate, which is a non-linear relationship in which the instantaneous flow rate quadratically increases as the lifting distance increases as shown in FIG. 8(*b*).

If the constant flow rate valve body 44 having the characteristic shown in FIG. 8 and the spring having the characteristic shown in FIG. 5 are used and disposed so that the spring produces a force that resists the force of the constant flow rate valve body 44 to open as described above with reference to FIGS. 2 and 3, the forces approximate each other at the flow rate of 60 L/min. If a spring having a linear characteristic suitable for the characteristic of the valve at a desired flow rate is used, the constant flow rate control in which the flow rate does not vary when the supply water pressure varies as shown in FIG. 10 can be achieved.

FIG. 11 shows a specific example of the shape of the constant flow rate valve body 44. As shown in FIG. 11, the inclined surface 441 (the outer surface) of the constant flow rate valve body 44 is shaped so as to deviate from the inner wall of the secondary-side internal flow channel 30 serving as the constant flow rate valve seat disposed around the constant flow rate valve body 44 as it goes downstream (downward in the drawing). With such a shape, the area of opening varies non-linearly with respect to the lifting distance (the amount of movement in the vertical direction in the drawing) of the constant flow rate valve body 44, and the relationship between the lifting distance and the instantaneous flow rate of water flowing through the gap illustrated in FIG. 8(*b*) can be achieved. In other words, the constant flow rate valve body 44 can have the characteristic shown in FIG. 8(*a*).

Figure 12:
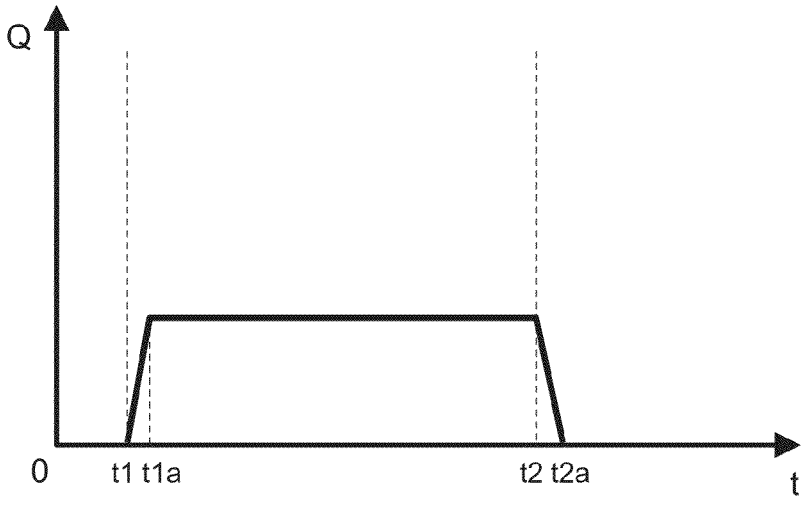
FIG. 12 is a graph showing a water discharge characteristic of the flush valve shown in FIG. 2.

With the flush valve SV according to this embodiment, the bypass flow channel 80 connects the second back pressure chamber 14 and the secondary-side internal flow channel 30 to each other. Since the second back pressure chamber 14 and the secondary-side internal flow channel 30 are connected to each other, the water in the second back pressure chamber 14 is first discharged as described above to cause the position controlling member 50 to lower to a position that depends on the primary pressure, thereby preventing an abrupt movement of the valve member 40. With such a configuration, as shown in FIG. 12, the flow rate of the discharge water increases in a period from a water discharge start time t1 to a time t1*a*, water discharge at a constant flow rate occurs in a period from the time t1*a* to a time t2, and the flow rate of the discharge water gradually decreases in a period from the time t2 to a water discharge end time t2*a* until the water discharge is stopped.

Figure 13:
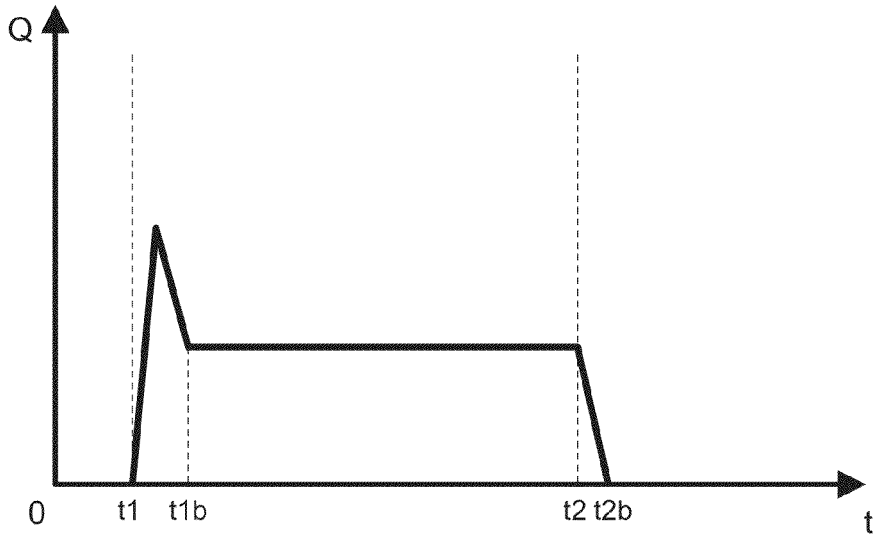
FIG. 13 is a graph showing a water discharge characteristic of a flush valve that has the outlet of a bypass flow channel at a different point than the flush valve shown in FIG. 2.

For comparison, FIG. 13 shows an example in which the bypass flow channel 80 connects the first back pressure chamber 16 and the secondary-side internal flow channel 30 to each other. In this case, the advantage of the design for dampening effect of the partitioning of the back pressure chamber into the first back pressure chamber 16 and the second back pressure chamber 14 disappears. As shown in FIG. 13, the flow rate of the discharge water abruptly increases until an overshoot occurs and then decreases in a period from the water discharge start time t1 to a time t1*b*, water discharge at a constant flow rate occurs in a period from the time t1*b* to the time t2, and then, the flow rate of the discharge water gradually decreases in a period from the time t2 to a water discharge end time t2*b* until the water discharge is stopped.

The flush valve SV according to this embodiment described above comprises the main body part 10 that has the inlet 21 for receiving the influent water Wa from the primary-side flow channel, which is the water supply source, and feeding the water to the primary-side internal flow channel 20 and the outlet 31 for feeding the effluent water Wb from the secondary-side internal flow channel 30 to the secondary-side flow channel, which is the water supply destination. In the main body part 10, the main valve body 42 (the main valve body surface 421) and the main valve seat surface 301 (the main valve seat) for opening and closing the flow channel between the primary-side internal flow channel 20 and the secondary-side internal flow channel 30, the spring 70 (the constant flow rate keeping part) and the position controlling member 50 are disposed to form the main valve. The flush valve SV further comprises the bypass flow channel 80 that connects the primary-side internal flow channel 20 and the secondary-side internal flow channel 30 to each other without via the part that functions as the main valve, and the sub-valve 82 for opening and closing the bypass flow channel 80.

Furthermore, the flush valve SV is configured so that when the sub-valve 82 is opened, the back pressure on the main valve body 42 decreases to open the main valve, and when the sub-valve 82 is closed after the water flows from the primary-side internal flow channel 20 to the secondary-side internal flow channel 30, the main valve is delayed closing and kept open until the back pressure on the main valve body 42 increases to be equal to the primary pressure in the primary-side internal flow channel 20. As delaying part of delaying closing of the main valve, the narrowed part 161, the narrowed flow channel 162, the hole 462 and the narrowed part 192 are provided.

The main valve incorporates the constant flow rate keeping part that operates to keep constant the main flow rate of the water flowing from the primary-side internal flow channel 20 to the secondary-side internal flow channel 30. What function as the constant flow rate keeping part are primarily the constant flow rate valve body 44 and the inner side wall of the secondary-side internal flow channel 30 that serves as the constant flow rate valve seat and include the spring 70, the position controlling member 50 and the wall member 60 that operate to adjust the distance between the constant flow rate valve body 44 and the inner side wall of the secondary-side internal flow channel 30 that serves as the constant flow rate valve seat. The main valve body 42 and the constant flow rate valve body 44 form the integral valve member 40.

In the flush valve SV according to this embodiment, the part that functions as the main valve incorporates the constant flow rate valve body 44 and the inner side wall of the secondary-side internal flow channel 30 that functions as the constant flow rate valve seat, and the main flow rate of the water flowing from the primary-side internal flow channel 20 to the secondary-side internal flow channel 30 is kept constant by adjusting the distance between the constant flow rate valve body 44 and the constant flow rate valve seat. Since the main valve body 42 and the constant flow rate valve body 44 are formed as the integral valve member 40, the main valve body 42 and the constant flow rate valve body 44 integrally moves when the valve member 40 is driven as described above. Thus, when the main valve body 42 is driven, the flow rate can be adjusted at the same time by that action, the differential pressure between the primary pressure and a secondary pressure can be increased, so that the main valve body 42 can be opened and closed more quickly. Consequently, the main valve for starting and stopping water supply can be opened and closed more quickly and downsized.

In the flush valve SV according to this embodiment, the main valve body 42 is disposed closer to the inlet 21 than the constant flow rate valve body 44, and when the valve member 40 is driven in the direction to cause the constant flow rate valve body 44 to reduce the flow rate, the main valve body 42 also operates in the direction to reduce the flow rate.

The flush valve SV is configured to supply water to a toilet bowl or the like that requires water supply at a relatively high instantaneous flow rate. In a situation where water flows from the primary-side internal flow channel 20 to the secondary-side internal flow channel 30 at such a high flow rate, it is extremely difficult to finely adjust the distance between the constant flow rate valve body 44 and the inner side wall of the secondary-side internal flow channel 30 that functions as the constant flow rate valve seat. In view of this, the main valve body 42 is disposed closer to the inlet 21 than the constant flow rate valve body 44 so that the water having passed through the main valve body 42 and the main valve seat surface 201 is supplied to the constant flow rate valve body 44, thereby reducing the influence of the water pressure variation on the constant flow rate valve body 44. Furthermore, since the main valve body 42 moves in the direction to reduce the flow rate when the valve member 40 is driven in the direction to cause the constant flow rate valve body 44 to reduce the flow rate, the flow channel from the primary-side internal flow channel 20 to the constant flow rate valve body 44 can be additionally narrowed, so that the influence of the water pressure variation on the constant flow rate valve body 44 can be readily and effectively reduced.

In the flush valve SV according to this embodiment, the spring 70 is disposed so as to apply to the main valve body 42 a force that balances with the force applied by the primary pressure in the primary-side internal flow channel 20. More specifically, since the position controlling member 50 abuts against the valve member 40 including the main valve body 42, the spring 70 is disposed so as to produce a force that balances with the force applied to the pressure receiving surface 607 of the wall member 60 fixed to the position controlling member 50. By the action of the spring 70, the opening of the main valve body 42 with respect to the main valve seat surface 201 is adjusted in accordance with the primary pressure.

The spring 70 is configured so that the relationship between the applied load and the displacement has a linear characteristic (see FIG. 5). However, the constant flow rate valve body 44 has such an outer shape that the relationship between the displacement of the valve member 40 and the main flow rate has a non-linear characteristic (see FIG. 8(*b*)) (see FIG. 11).

In general, in flow rate adjustment by a valve comprising a valve seat and a valve body that come into contact with each other in a plane, the relationship between the distance between the valve seat and the valve body and the water pressure has a non-linear characteristic: as the distance increases, the decrement of the water pressure increases (see FIG. 4). If a spring that exhibits a linear relationship between the applied load and the displacement is used as in this preferred embodiment, the arrangement is simple, but the forces balance with each other at fewer points since the valve has a non-linear characteristic, and the main flow rate varies (see FIGS. 6 and 7). Thus, in this preferred embodiment, the outer shape of the constant flow rate valve body 44 is designed so that the relationship between the displacement of the valve member 40 and the main flow rate has a non-linear characteristic, and as a result, the relationship between the distance between the constant flow rate valve body 44 and the constant flow rate valve seat and the water pressure has a linear characteristic (see FIG. 8(*a*)), thereby preventing the main flow rate from varying even if the spring having a linear characteristic is used.

According to this embodiment, preferably, the valve member 40 is formed by molding of a resin material, and at least the constant flow rate valve body 44 is formed by molding of a resin material. By resin molding, the constant flow rate valve body 44 can be readily formed to have the outer shape having the characteristic described above.

In the flush valve SV according to this embodiment, the spring 70 is configured so as to produce a higher repulsive force when the position controlling member 50 moves in the direction to reduce the range of movement of the valve member 40 and is disposed so as to separate the valve member 40 and the position controlling member 50 from each other when the main valve body 42 and the main valve seat surface 201 abut against each other to close the flow channel between the primary-side internal flow channel 20 and the secondary-side internal flow channel 30.

Since the position controlling member 50 that moves in the sliding direction of the valve member 40 to adjust the range of movement of the valve member 40 and the spring 70 that adjusts the position of the position controlling member 50 by making the force of the position controlling member 50 and the primary pressure equal to each other are parts of the main valve, the constant flow rate can be achieved by adjusting the range of movement of the valve member 40 by adjusting the position of the position controlling member 50 with a simple arrangement including the spring 70. According to this embodiment, the spring 70 is configured to increase the repulsive force when the position controlling member 50 moves in the direction to reduce the range of movement of the valve member 40, the valve member 40 and the position controlling member 50 are disposed so as to be spaced apart from each other when water supply is stopped in order to stop water supply with reliability even when the primary pressure is low. In this way, since the valve member 40 and the position controlling member 50 are disposed so as to be spaced apart from each other when the main valve body 42 and the main valve seat surface 201 abut against each other to close the flow channel between the primary-side internal flow channel 20 and the secondary-side internal flow channel 30 to stop water supply, the constant flow rate can be achieved and at the same time the water supply can be stopped with reliability with a simple arrangement including the spring 70 and the position controlling member 50.

The flush valve SV according to this embodiment has the first back pressure chamber 16 and the second back pressure chamber 14 as a back pressure chamber through which the water flowing from the primary-side internal flow channel 20 to the secondary-side internal flow channel 30 does not pass when the sub-valve 82 is closed and which accumulates the influent water from the primary-side internal flow channel 20 and is configured so that the primary pressure is applied in the direction to push the main valve body 42 toward the main valve seat surface 201. The bypass flow channel 80 connects the second back pressure chamber 14 and the secondary-side internal flow channel 20 to each other. The back pressure chamber is divided by the partition wall 19 into the first back pressure chamber 16 that is formed on the same side as the primary-side internal flow channel 20 and applies a back pressure to the valve member 40 and the second back pressure chamber 14 formed on the same side as the bypass flow channel 80. When the sub-valve 82 is opened, the water accumulated in the second back pressure chamber 14 first flows out to the bypass flow channel 80.

On the opposite side of the first back pressure chamber 16 and the second back pressure chamber 14 as the back pressure chamber to the valve member 40, the sub-back pressure chamber 12 in communication with the primary-side internal flow channel 20 is provided. The wall member 60 that separates the sub-back pressure chamber 12 and the second back pressure chamber 14 from each other is slidable in the sliding direction of the valve member 40, and the wall member 60 and the position controlling member 50 are coupled with each other and integrally slide.

Since the bypass flow channel 80 connects the second back pressure chamber 14 and the secondary-side internal flow channel 30 to each other as described above, when the sub-valve 82 is opened, the water in the second back pressure chamber 14 is drawn out, the internal pressure of the first back pressure chamber 16 and the second back pressure chamber 14 decreases, the main valve body 42 separates from the main valve seat surface 201, and the water flows into the secondary-side internal flow channel 30. When the sub-valve 82 is closed, the influent water from the primary-side internal flow channel 20 is accumulated, and the primary pressure acts in the direction to push the main valve body 42 toward the main valve seat surface 201, so that water supply can be stopped with reliability.

Furthermore, according to this embodiment, the sub-back pressure chamber 12 to which the primary pressure is applied is provided, and the wall member 60 that separates the sub-back pressure chamber 12 and the second back pressure chamber 14 from each other and the position controlling member 50 are pushed toward the valve member 40 by the primary pressure. Therefore, when the sub-valve 82 is opened, and the pressure in the second back pressure chamber 14 decreases, the wall member 60 is pushed toward the valve member 40 to suppress an abrupt movement of the valve member 40, so that the flow rate can be more stably controlled.

Furthermore, when the sub-valve 82 is opened, and the pressure in the back pressure chamber decreases, the second back pressure chamber 14 closer to the bypass flow channel 80 first discharges water to reduce pressure, and the first back pressure chamber 16 that applies the back pressure to the valve member 40 is delayed reducing pressure. As a result, the wall member 60 and the position controlling member 50 are first pushed toward the valve member 40, and then, the valve member 40 is pushed toward the position controlling member 50 so that the main valve body 42 separates from the main valve seat surface 201. Such an operation can prevent an abrupt movement of the valve member 40 that can leads to an overshoot with reliability, and the flow rate can be more stably controlled.

According to this embodiment, the narrowed part 192 for regulating the flow of water through the flow channel from the first back pressure chamber 16 to the second back pressure chamber 14 is provided between the first back pressure chamber 16 and the second back pressure chamber 14. Since the narrowed part 192 for regulating the flow of water through the flow channel from the first back pressure chamber 16 to the second back pressure chamber 14 is provided, the flow of water from the first back pressure chamber 16 to the second back pressure chamber 14 can be dampened with a simple arrangement, and it can be assured that the second back pressure chamber 14 discharge water earlier than the first back pressure chamber 16.

According to this embodiment, the spring 70 is disposed in the second back pressure chamber 14 between the partition wall 19 and the wall member 60 and is configured to increase the repulsive force when the wall member 60 and the position controlling member 50 are pushed toward the valve member 40. Since the spring 70 is disposed in the second back pressure chamber 14 between the partition wall 19 and the wall member 60, the spring 70 produces a force to push back the wall member 60 and the position controlling member 50 when the wall member 60 and the position controlling member 50 are pushed toward the valve member 40. Furthermore, since the spring 70 is not disposed in the sub-back pressure chamber 12 but in the second back pressure chamber 14, where water stagnation does not occur and an air pocket is not regularly formed, deterioration such as corrosion of the spring 70 can be prevented with reliability.

According to this embodiment, between the wall member 60 and the inner wall surface of the sub-back pressure chamber 12, the C-ring is provided as a sealing member configured to seal the area of contact between the wall member 60 and the inner wall surface while permitting air to pass through a part thereof.

The sub-back pressure chamber 12 is in communication with the primary-side internal flow channel 20 and always receives the primary pressure, so that the water in the sub-back pressure chamber 12 can hardly circulate, and air flowing into the sub-back pressure chamber 12 is unlikely to be discharged to the outside and thus is likely to form an air pocket. If the air pocket is allowed to remain unaddressed, the characteristic balance between the force to push the wall member 60 and the position controlling member 50 and the repulsive force of the spring 70 may change, or the inner wall surface of the sub-back pressure chamber 12 or the sealing member may deteriorate, to cause a change in the movement of the position controlling member 50, thereby reducing the precision of the constant flow rate control. To avoid this, the C-ring configured to seal the area of contact between the wall member 60 and the inner wall surface of the sub-back pressure chamber 12 while permitting air to pass through a part thereof is provided to let the air escape while maintaining the primary pressure in the sub-back pressure chamber 12, thereby preventing occurrence of an air pocket.

According to this embodiment, the partition wall 19 has the hollow part 191 that protrudes toward the valve member 40 and houses the spring 70, and the valve member 40 has the housing hollow part 46 in which the protruding hollow part 191 can be housed. With such a configuration, even if the spring 70 has a sufficient length, the valve member 40 can slide without interfering with the partition wall 19. Since the spring 70 has a sufficient length, the spring 70 does not excessively sensitively respond to a variation in pressure in the flow channel, and the precision of the constant flow rate control can be improved.

According to this embodiment, the space 464 into which water flows from the primary-side internal flow channel 20 is formed between the part of the hollow part 191 that protrudes toward the valve member 40 and the valve member 40. Since the space into which water flows from the primary-side internal flow channel 20 is formed between the part of the hollow part 191 that protrudes toward the valve member 40 and the valve member 40, vibrations of the valve member 40 can be reduced to stabilize the movement of the valve member 40.

According to this embodiment, as the pulsation reducing part of reducing a pulsation of the valve member 40 caused by a pulsation of the primary pressure, the narrowed part 222 and the C-ring are provided. Since the pulsation reducing part of reducing a pulsation (a hunting) of the valve member 40 caused by a pulsation of the primary pressure is provided, the valve member 40 can stably remain at a predetermined position even when water is supplied at a relatively high flow rate, so that the distance between the constant flow rate valve body 44 and the constant flow rate valve seat can be prevented from being affected by such a pulsation of the primary pressure, and a pulsation of the flow rate can be prevented.

According to this embodiment, the valve member 40 effectively has the pressure receiving surface 607 that receives the primary pressure via the position controlling member 50 and can move back and forth in response to the pressure applied to the pressure receiving surface 607. In the flow channel between the primary-side internal flow channel 20 and the pressure receiving surface 607, the narrowed part 222 serving as the pulsation reducing part is provided by narrowing down the cross sectional area of the flow channel as an attenuation mechanism for attenuating a pulsation of the primary pressure.

Since the valve member 40 can be regarded as effectively having the pressure receiving surface 607 that receives the primary pressure in the primary-side internal flow channel 20 and can move back and forth in response to the pressure applied to the pressure receiving surface 607, the valve member 40 can be maintained at a predetermined position with reliability by controlling the pressure applied to the pressure receiving surface 607. Since the narrowed part 222 as the attenuation mechanism for attenuating a pulsation of the primary pressure is provided in the flow channel between the primary-side internal flow channel 20 and the pressure receiving surface 607 by narrowing down the cross sectional area of the flow channel, the influence of the pressure variation on the pressure receiving surface 607 can be minimized simply by narrowing down the flow channel.

According to this embodiment, the water flowing from the primary-side internal flow channel 20 into the valve member 40 is introduced in a direction perpendicular to the direction of the back and forth movement of the valve member 40, and the pressure receiving surface 607 is oriented to face in the direction of the back and forth movement of the valve member 40. Since the water flowing from the primary-side internal flow channel 20 into the valve member 40 is introduced in a direction perpendicular to the direction of the back and forth movement of the valve member 40, and the pressure receiving surface 607 is oriented to face in the direction of the back and forth movement of the valve member 40, the influence of the variation of the primary pressure on the pressure receiving surface 607 can be reduced.

According to this embodiment, the valve member 40 can be regarded as effectively having the pressure receiving surface 607 that receives the primary pressure and can move back and forth in response to the pressure applied to the pressure receiving surface 607. As the pulsation reducing part, there is provided the C-ring that serves as the dampening member interposed between the valve member 40 and the inner wall of the main body part to reduce the influence of a pulsation of the primary pressure on the movement of the valve member 40 and to dampen the movement of the valve member 40.

As described above, as the pulsation reducing part, there is provided the C-ring that serves as the dampening member interposed between the valve member 40 and the inner wall of the main body part to reduce the influence of a pulsation of the primary pressure on the movement of the valve member 40 and to dampen the movement of the valve member 40. In this way, the influence of the pressure variation on the valve member 40 can be minimized simply by providing a dampening member that increases friction, such as the C-ring and a rubber ring.

According to this embodiment, the valve member 40 slides to make the main valve body 42 (the main valve body surface 421) abut against the main valve seat surface 201 and separate the main valve body 42 from the main valve seat surface 201. In order to prevent the valve member 40 from rubbing against the surrounding inner wall of the main body part 10 and to allow smooth sliding of the valve member 40, the valve side protrusions 442 and the C-ring 48 are provided as the stabilizing part of preventing inclination of the valve member 40.

Since the stabilizing part of preventing inclination of the valve member 40 is provided, the valve member 40 can stably slide even when water is supplied at a relatively high flow rate. Thus, the valve member 40 is prevented from rubbing against the surrounding inner wall of the main body part 10 and allowed to smoothly slide, and the constant flow rate control can be stably achieved.

According to this embodiment, the stabilizing part are the valve side protrusions 442 and the C-ring 48 that are parts of the valve member 40 and serve as guide parts to come into contact with a part of the main body part 10, thereby allowing the valve member 40 to slide without being inclined. The valve member 40 can be allowed to stably slide without being inclined simply by using parts of the valve member 40 as guide parts, and the constant flow rate control can be stably achieved.

According to this embodiment, the stabilizing part are the valve side protrusions 442 that are parts of the valve member 40 and serve as guide parts to come into contact with parts of the primary-side internal flow channel 20 and the secondary-side internal flow channel 30, thereby allowing the valve member 40 to slide without being inclined.

The water flowing in the primary-side internal flow channel 20 and the secondary-side internal flow channel 30 tends to cause an inclination of the valve member 40 when the flow rate is high. The guide parts are provided at a part of the flow channel that is most likely to receive the force that causes the inclination to assure that the valve member 40 can slide without being inclined.

According to this embodiment, the guide parts are the valve side protrusions 442 provided on the downstream end part of the valve member 40. The water flowing in the primary-side internal flow channel 20 and the secondary-side internal flow channel 30 tends to cause an inclination of the valve member 40 when the flow rate is high, and the force increases as it flows downstream. Since the valve side protrusions 442 serving as the guide parts are provided at the downstream end of the valve member 40, the guiding effect can be adequately achieved even when the valve side protrusions 442 are short.

According to this embodiment, the C-ring 48, which also serves as the guide part, is provided on the opposite end part of the valve member 40. Since the guide parts are provided on both end parts of the valve member 40, the valve member 40 can be prevented from being inclined at both ends and therefore with higher reliability.

According to this embodiment, since the valve side protrusions 442 are formed integrally with the valve member 40, an inclination of the valve member 40 can be prevented with a simpler arrangement than a case where the valve member 40 has separate protrusions and a dimension error or assembly error can cause an inclination of the valve member 40.

Figure 14:
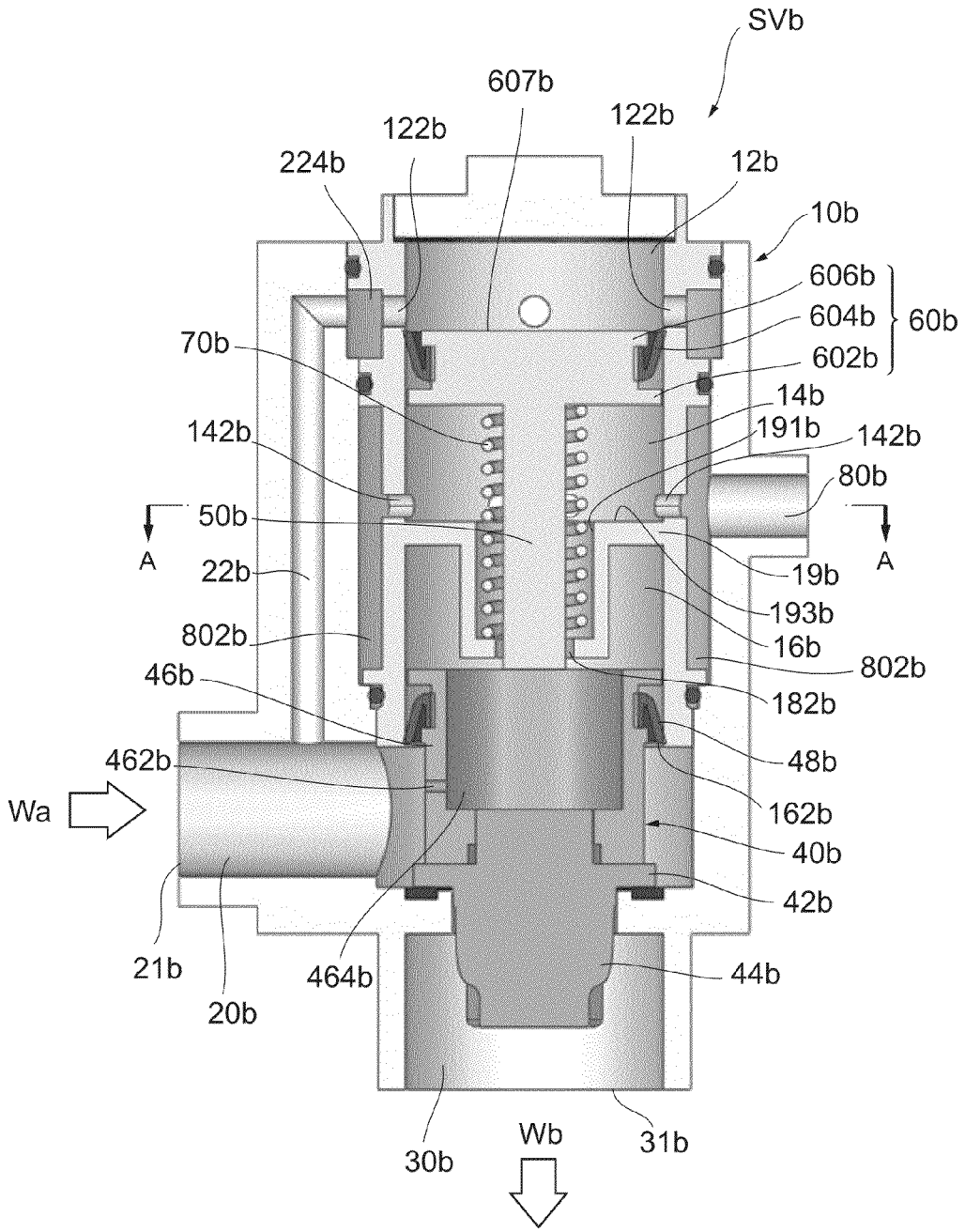
FIG. 14 is a diagram showing a configuration of an example of the actually constructed flush valve shown in FIG. 2.

Next, as an example of the actually constructed flush valve SV shown in FIG. 2, a flush valve SVb will be described with reference to FIG. 14. FIG. 14 is a diagram showing a configuration of the flush valve SVb, which is an example of the actually constructed flush valve SV shown in FIG. 2.

As shown in FIG. 14, the flush valve SVb has a main body part 10*b*, in the main body part 10*b*, a primary-side internal flow channel 20*b*, a secondary-side internal flow channel 30*b*, a first back pressure chamber 16*b* (a back pressure chamber), a second back pressure chamber 14*b* (a back pressure chamber) and a sub-back pressure chamber 12*b* are formed. The primary-side internal flow channel 20*b* receives influent water Wa from a primary-side flow channel, which is a water supply source, and feeds the water to the secondary-side internal flow channel 30*b*. An inlet 21*b* is provided at an upstream end of the primary-side internal flow channel 20*b*. The inlet 21*b* is an opening for receiving the influent water Wa and feeding the water to the primary-side internal flow channel 20*b*.

The secondary-side internal flow channel 30*b* feeds influent water from the primary-side internal flow channel 20*b* to the secondary-side flow channel, which is a water supply destination, as effluent water Wb. An outlet 31*b* is provided at a downstream end of the secondary-side internal flow channel 30*b*. The outlet 31*b* is an opening for feeding the effluent water Wb from the secondary-side internal flow channel 30*b* to the secondary-side flow channel.

A valve member 40*b* having a main valve body 42*b* that opens and closes the flow channel between the primary-side internal flow channel 20*b* and the secondary-side internal flow channel 30*b* is disposed between the primary-side internal flow channel 20*b* and the secondary-side internal flow channel 30*b*. One end of the valve member 40*b* on the downstream side is inserted into the secondary-side internal flow channel 30*b*, and the opposite end faces the second back pressure chamber 14*b*. The valve member 40*b* is disposed so as to be capable of moving back and forth in the direction of extension of the secondary-side internal flow channel 30*b*. A constant flow rate valve body 44*b* (constant flow rate keeping part) is provided on the valve member 40*b* in a part downstream from the main valve body 42*b*.

The valve member 40*b* has a housing hollow part 46*b* provided on the opposite side of the main valve body 42*b* to the constant flow rate valve body 44*b*. The housing hollow part 46*b* has the shape of a recess that retreats from the first back pressure chamber 16*b*. A U-packing 48*b* is provided at an end of the housing hollow part 46*b* closer to the first back pressure chamber 16*b*. The U-packing 48*b* is disposed so as to abut against the inner side wall of the main body part 10*b* in a part closer to the secondary-side internal flow channel 30*b* than the first back pressure chamber 16*b*.

A gap into which water can flow is formed between the U-packing 48*b* and the main valve body 42*b* to form a narrowed flow channel 162*b*. Thus, water having passed through the primary-side internal flow channel 20*b* flows into a space between the housing hollow part 46*b* and the main body part 10*b* at a reduced speed.

The housing hollow part 46*b* has a hole 462*b* that connects the primary-side internal flow channel 20*b* and the first back pressure chamber 16*b* to each other. Therefore, water flows from the primary-side internal flow channel 20*b* into the first back pressure chamber 16*b* through the hole 462*b*.

The first back pressure chamber 16*b* and the second back pressure chamber 14*b* are separated by a partition wall 19*b*. The partition wall 19*b* has a hollow part 191*b*. The hollow part 191*b* has the shape of a recess whose outer wall protrudes from the second back pressure chamber 14*b* into the first back pressure chamber 16*b*. A spring 70*b* (constant flow rate keeping part) having a linear characteristic is disposed on the same side of the hollow part 191*b* as the second back pressure chamber 14*b*. The spring 70*b* is housed in the hollow part 191*b* at one end and abuts, at the other end, against a wall member 60*b* that separates the sub-back pressure chamber 12*b* and the second back pressure chamber 14*b* from each other.

A bottom surface of the hollow part 191*b* is shaped to allow a rod-shaped position controlling member 50*b* to pass therethrough, and a gap is formed between the bottom surface of the hollow part 191*b* and the position controlling member 50*b* to provide a narrowed part 192*b*. Thus, water flows from the primary-side internal flow channel 20*b* into the first back pressure chamber 16*b* through the hole 462*b* and then flows into the second back pressure chamber 14*b* through the narrowed part 192*b*.

The position controlling member 50*b* is disposed so as to pass through the center of the windings of the spring 70*b*. The position controlling member 50*b* is disposed so as to abut against or separate from the bottom surface of the housing hollow part 46*b* of the valve member 40*b* at one end and fixed to the wall member 60*b* at the other end.

The housing hollow part 46*b* is configured to house the hollow part 191*b* of the partition wall 19*b* when the valve member 40*b* comes close to the partition wall 19*b*. A space 464*b* is provided between the housing hollow part 46*b* and the hollow part 191*b* and filled with water to dampen the movement of the housing hollow part 46*b* with respect to the hollow part 191*b*, thereby stabilizing the movement of the valve member 40*b*.

The wall member 60*b* has a lower wall member 602*b*, a U-packing 604*b* and an upper wall member 606*b*. The lower wall member 602*b* is a wall that faces the second back pressure chamber 14*b*. The upper wall member 606*b* is a wall that faces the sub-back pressure chamber 12*b*. The U-packing 604*b* is held between the lower wall member 602*b* and the upper wall member 606*b*. The U-packing 604*b* is disposed in close contact with the inner side wall of the main body part 10*b* in a part between the sub-back pressure chamber 12*b* and the second back pressure chamber 14*b*.

The wall member 60*b* is configured to slide so as to expand the sub-back pressure chamber 12*b* (narrow the second back pressure chamber 14*b*) or narrow the sub-back pressure chamber 12*b* (expand the second back pressure chamber 14*b*) depending on the pressure difference between the sub-back pressure chamber 12*b* and the second back pressure chamber 14*b*. Since the position controlling member 50*b* is fixed to the lower wall member 602*b* of the wall member 60*b*, the position controlling member 50*b* moves when the wall member 60*b* slides.

The pressure applied to the sub-back pressure chamber 12*b* is equal to a primary pressure applied to the primary-side internal flow channel 20*b*. More specifically, the primary-side internal flow channel 20*b* and the sub-back pressure chamber 12*b* are connected to each other by a sub-primary flow channel 22*b*, and the primary pressure is exerted also to the sub-back pressure chamber 12*b*. An annular flow channel 224*b* is formed on the same side of the sub-primary flow channel 22*b* as the sub-back pressure chamber 12*b* to surround the sub-back pressure chamber 12*b*. The annular flow channel 224*b* and the sub-back pressure chamber 12*b* are connected to each other by a plurality of communicating holes 122*b*. The plurality of communicating holes 122*b* is formed at equal intervals around the outer perimeter of the sub-back pressure chamber 12*b* perpendicular to the sliding direction of the valve member 40*b*. Since a plurality of communicating holes 122*b* into which water flows from the sub-primary flow channel 22*b* for applying the primary pressure to the sub-back pressure chamber 12*b* is formed at equal intervals around the outer perimeter of the sub-back pressure chamber 12*b* perpendicular to the sliding direction of the valve member 40*b*, the movement of the wall member 60*b* for controlling the movement of the valve member 40*b* can be stabilized, and the valve member 40*b* can more stably slide.

Figure 15:
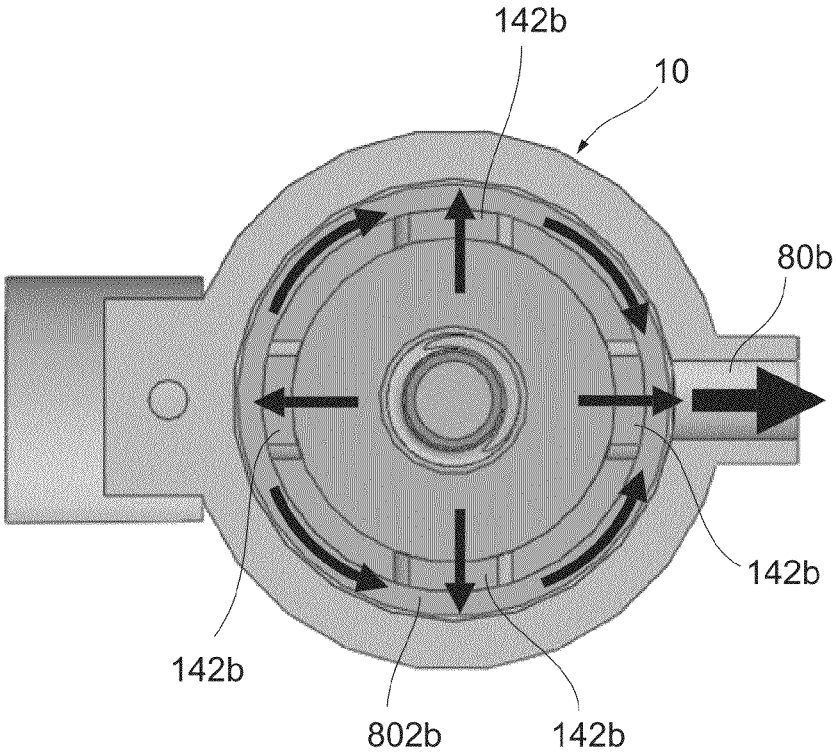
FIG. 15 is a cross-sectional view of the flush valve taken along the line A-A in FIG. 14.

The second back pressure chamber 14*b* and the secondary-side internal flow channel 30*b* are connected to each other by a bypass flow channel 80*b*. An expanded part 802*b* that surrounds the second back pressure chamber is formed on the same side of the bypass flow channel 80*b* as the second back pressure chamber 14*b*. The expanded part 802*b* and the second back pressure chamber 14*b* are connected to each other by a plurality of communicating holes 142*b*. FIG. 15 is a cross-sectional view taken along the line A-A in FIG. 14 for explaining this configuration. As shown in FIG. 15, four communicating holes 142*b* are formed at equal intervals around the outer perimeter of the second back pressure chamber 14*b* perpendicular to the sliding direction of the valve member 40*b*.

With the flush valve SVb, as described above, on the same side of the bypass flow channel 80*b* as the second back pressure chamber 14*b*, the expanded part 802*b* is formed by expanding the cross sectional area of the flow channel to reduce the speed of the water flowing out of the bypass flow channel 80*b* when a sub-valve on the bypass flow channel 80*b* is opened.

Since the bypass flow channel 80*b* connects the second back pressure chamber 14*b* and the secondary-side internal flow channel 30*b* to each other, when the sub-valve on the bypass flow channel 80*b* is opened, the water in the second back pressure chamber 14*b* and the first back pressure chamber 16*b* is drawn out, the internal pressure of the second back pressure chamber 14*b* and the first back pressure chamber 16*b* decreases, the main valve body 42*b* separates from the main valve seat, and water flows into the secondary-side internal flow channel 30*b*. In this situation, if the speed of the water flowing out of the bypass flow channel 80*b* when the sub-valve on the bypass flow channel 80*b* is opened is high, and the water in the second back pressure chamber 14*b* and the first back pressure chamber 16*b* is abruptly drawn out, the main valve body 42 moves unstably. Thus, the expanded part 802*b* is provided by expanding the cross sectional area of the flow channel to reduce the speed of the water flowing out of the bypass flow channel 80*b*, thereby stabilizing the movement of the main valve body 42*b* and the movement of the constant flow rate valve body 44*b* formed integrally with the main valve body 42*b*.

In the flush valve SVb, the expanded part 802*b* and the second back pressure chamber 14*b* are in communication with each other via the communicating holes 142*b* having an opening area smaller than the cross sectional area of the flow channel of the expanded part 802*b*, and the communicating holes 142*b* are formed at equal intervals around the outer perimeter of the second back pressure chamber 14*b* perpendicular to the sliding direction of the valve member 40*b*.

With such a configuration, water flowing from the second back pressure chamber 14*b* into the bypass flow channel 80*b* is equally distributed in a plane perpendicular to the sliding direction of the valve member 40*b*. As a result, the influence of the water flowing from the second back pressure chamber 14*b* into the bypass flow channel 80*b* on the valve member 40*b* is balanced, and the valve member 40*b* more stably slides.

In the flush valve SVb, the communicating holes 142*b* are formed in the vicinity of a flat surface 193*b* of the hollow part

19*b*, which is a wall surface of the second back pressure chamber 14*b* perpendicular to the sliding direction of the valve member 40*b*.

Since the holes connecting the expanded part 802*b* and the second back pressure chamber 14*b* to each other are formed in the vicinity of the flat surface 193*b* of the hollow part 19*b*, which is a wall surface of the second back pressure chamber 14*b* perpendicular to the sliding direction of the valve member 40*b*, water flows out through the communicating holes 142*b* along the flat surface 193*b*. As a result, the influence of the flow of water on the sliding of the valve member 40*b* can be reduced by the rectification effect of the flat surface 193*b*, and the valve member 40*b* more stably slides.

Figure 16:
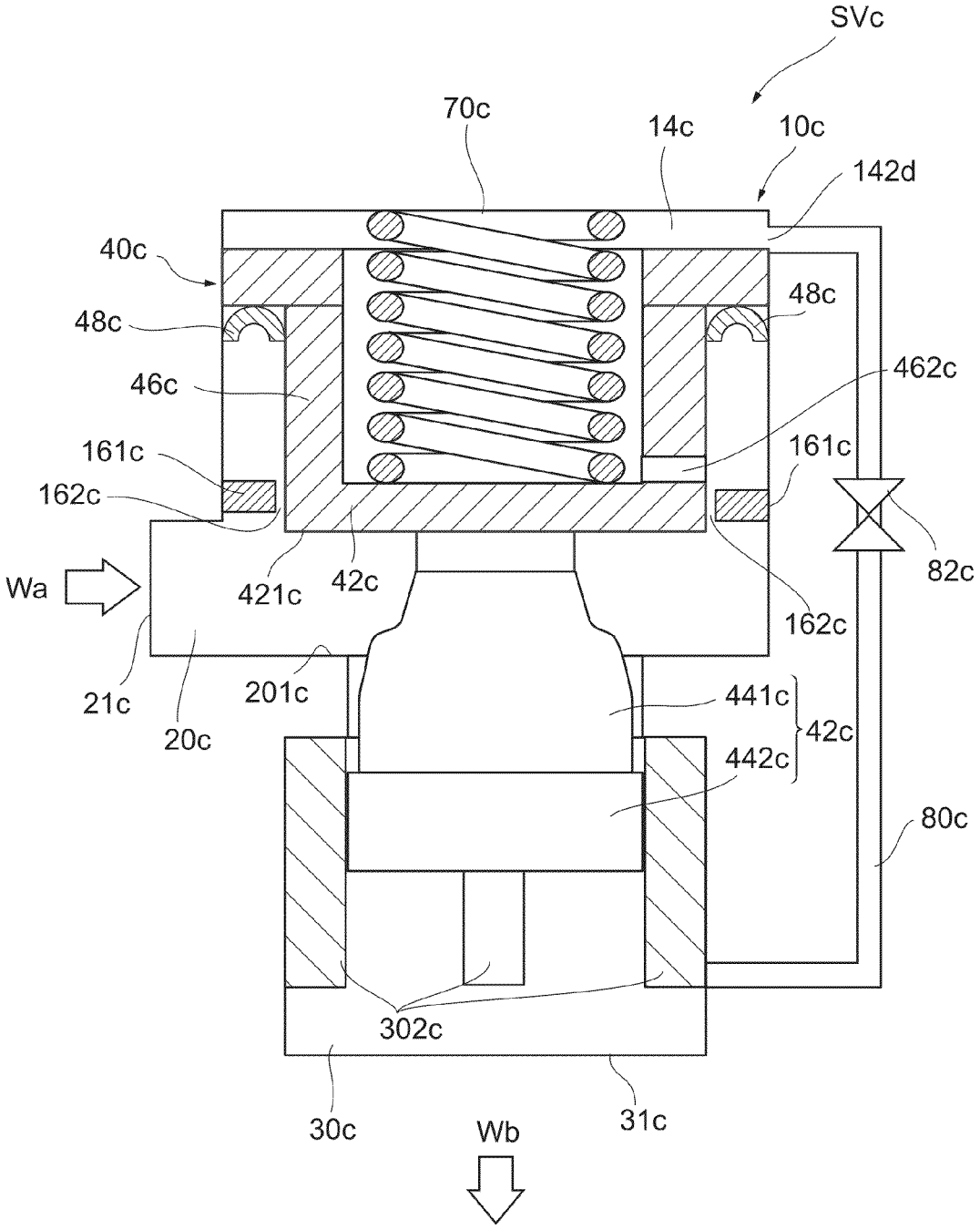
FIG. 16 is a schematic diagram showing an internal structure of a flush valve according to a second embodiment of the present invention.

Next, a flush valve SVc according to a second embodiment of the present invention will be described with reference to FIG. 16. FIG. 16 is a schematic diagram showing an internal structure of the flush valve SVc according to the second embodiment of the present invention.

As shown in FIG. 16, the flush valve SVc has a main body part 10*c*. In the main body part 10*c*, a primary-side internal flow channel 20*c*, a secondary-side internal flow channel 30*c* and a back pressure chamber 14*c* are formed. The primary-side internal flow channel 20*c* receives influent water Wa from a primary-side flow channel, which is a water supply source, and feeds the water to the secondary-side internal flow channel 30*c*. An inlet 21*c* is provided at an upstream end of the primary-side internal flow channel 20*c*. The inlet 21*c* is an opening for receiving the influent water Wa and feeding the water to the primary-side internal flow channel 20*c*.

The secondary-side internal flow channel 30*c* feeds influent water from the primary-side internal flow channel 20*c* to a secondary-side flow channel, which is a water supply destination, as effluent water Wb. An outlet 31*c* is provided at a downstream end of the secondary-side internal flow channel 30*c*. The outlet 31*c* is an opening for feeding the effluent water Wb from the secondary-side internal flow channel 30*c* to the secondary-side flow channel.

A valve member 40*c* having a main valve body 42*c* that opens and closes the flow channel between the primary-side internal flow channel 20*c* and the secondary-side internal flow channel 30*c* is disposed between the primary-side internal flow channel 20*c* and the secondary-side internal flow channel 30*c*. One end of the valve member 40*c* on the downstream side is inserted into the secondary-side internal flow channel 30*c*, and the opposite end faces the back pressure chamber 14*c*. The valve member 40*c* is disposed so as to be capable of moving back and forth in the direction of extension of the secondary-side internal flow channel 30*c*.

A surface of the main valve body 42*c* on the downstream side forms a main valve body surface 421*c*. When the valve member 40*c* is pushed to the downstream limit, the main valve body surface 421*c* abuts against a boundary surface of the primary-side internal flow channel 20*c* to the secondary-side internal flow channel 30*c*, thereby blocking the flow of water between the primary-side internal flow channel 20*c* and the secondary-side internal flow channel 30*c*. Thus, the boundary surface against which the main valve body surface 421*c* abuts functions as a main valve seat surface 201*c* (a main valve seat).

A constant flow rate valve body 44*c* (constant flow rate keeping part) is provided on the valve member 40*c* in a part downstream of the main valve body 42*c*. The constant flow rate valve body 44*c* has an inclined surface 441*c* (an outer surface) and an abutment part 442*c* (a guide part or stabilizing part). The abutment part 442*c* is provided to abut against flow channel side protrusions 302*c* (guide parts or stabilizing part) formed on the side wall of the secondary-side internal flow channel 30*c*. A plurality of flow channel side protrusions 302*c* is provided along the perimeter of the flow channel so as to abut against the abutment part 442*c* at different positions. Since the abutment part 442*c* abuts against the flow channel side protrusions 302*c* when the valve member 40*c* slides back and forth, the valve member 40*c* can stably slide without being inclined.

Since the distance between the inclined surface 441*c* of the constant flow rate valve body 44*c* and the inner side wall of the secondary-side internal flow channel 30*c* is variable, the inner side wall of the secondary-side internal flow channel 30*c* serves as a constant flow rate valve seat for the constant flow rate valve. The inclined surface 441*c* is formed so as to come closer to the inner side wall of the secondary-side internal flow channel 30*c* as it goes from the main valve body 42*c* toward the outlet 31*c*.

Consequently, when the valve member 40*c* moves upward (in the direction to enter the back pressure chamber 14*c*) so as to allow water to pass through between the primary-side internal flow channel 20*c* and the secondary-side internal flow channel 30*c*, the minimum distance between the inclined surface 441*c* of the constant flow rate valve body 44*c* and the inner side wall of the secondary-side internal flow channel 30*c* decreases, so that the flow rate of water decreases. If the valve member 40*c* once moving upward (in the direction to enter the back pressure chamber 14*c*) so as to allow water to pass through between the primary-side internal flow channel 20*c* and the secondary-side internal flow channel 30*c* then moves downward (in the direction toward the outlet 31*c*), the minimum distance between the inclined surface 441*c* of the constant flow rate valve body 44*c* and the inner side wall of the secondary-side internal flow channel 30*c* increases, so that the flow rate of water increases.

The valve member 40*c* has a housing hollow part 46*c* provided on the opposite side of the main valve body 42*c* to the constant flow rate valve body 44*c*. The housing hollow part 46*c* has the shape of a recess that retreats from the back pressure chamber 14*c*. A U-packing 48*c* is provided at an end of the housing hollow part 46*c* closer to the back pressure chamber 14*c*. The U-packing 48*c* is disposed so as to abut against the inner side wall of the main body part 10*c* in a part closer to the secondary-side internal flow channel 30*c* than the back pressure chamber 14*c*.

As described above, the abutment part 442*c* abuts against the flow channel side protrusions 302*c* at one end of the valve member 40*c*, and the U-packing 48*c* abuts against the inner side wall of the main body part 10*c* at the other end of the valve member 40*c*. Thus, the valve member 40*c* is designed to slide with its opposite ends held so as to prevent inclination of the valve member 40*c*.

A narrowed part 161*c* is formed on the inner side wall of the main body part 10*c* so as to protrude therefrom in a part between the U-packing 48*c* and the main valve body 42*c*. A gap, which serves as a narrowed flow channel 162*c*, is formed between the narrowed part 161*c* and the housing hollow part 46*c*. Thus, water flows from the primary-side internal flow channel 20*c* into an intermediate chamber 18*c*, which is defined between the housing hollow part 46*c* and the inner side wall of the main body part 10*c*, at a speed reduced by the narrowed flow channel 162*c*.

The housing hollow part 46*c* has a hole 462*c* that connects the intermediate chamber 18*c* and the back pressure chamber 14*c* to each other. Therefore, the water flowing from the primary-side internal flow channel 20*c* into the intermediate chamber 18*c* flows into the back pressure chamber 14*c* through the hole 462*c*.

A spring 70*c* (constant flow rate keeping part) having a linear characteristic is disposed between the upper wall surface of the back pressure chamber 14*c* and the housing hollow part 46*c*. The spring 70*c* is housed in the housing hollow part 46*c* at one end and abuts, at the other end, against the upper wall surface of the back pressure chamber 14*c*.

According to this embodiment, the primary pressure is applied to the main valve body surface 421*c*, and the spring 70*c* is disposed so as to produce a force that resists the primary pressure, so that the main valve body surface 421*c* serves also as a pressure receiving surface.

The back pressure chamber 14*c* and the secondary-side internal flow channel 30*c* are connected to each other by a bypass flow channel 80*c*. A sub-valve 82*c* is provided on the bypass flow channel 80*c*. If the sub-valve 82*c* is closed, and the back pressure chamber 14*c* is filled with water, the primary pressure is applied in the back pressure chamber 14*c*. If the sub-valve 82*c* is opened, the water in the back pressure chamber 14*c* flows to the secondary-side internal flow channel 30*c* through the bypass flow channel 80*c*, and the internal pressure of the back pressure chamber 14*c* decreases.

Figure 17A:
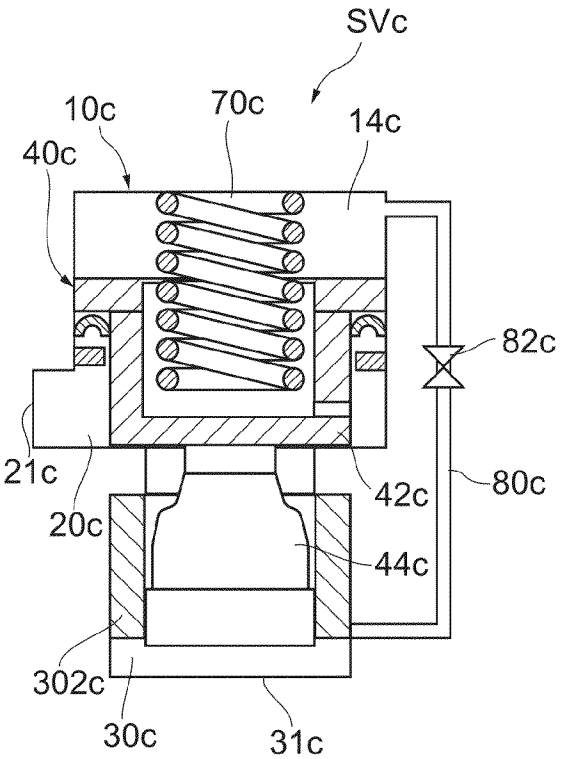
FIG. 17 includes diagrams for illustrating a water discharge operation of the flush valve shown in FIG. 16.
Figure 17B:
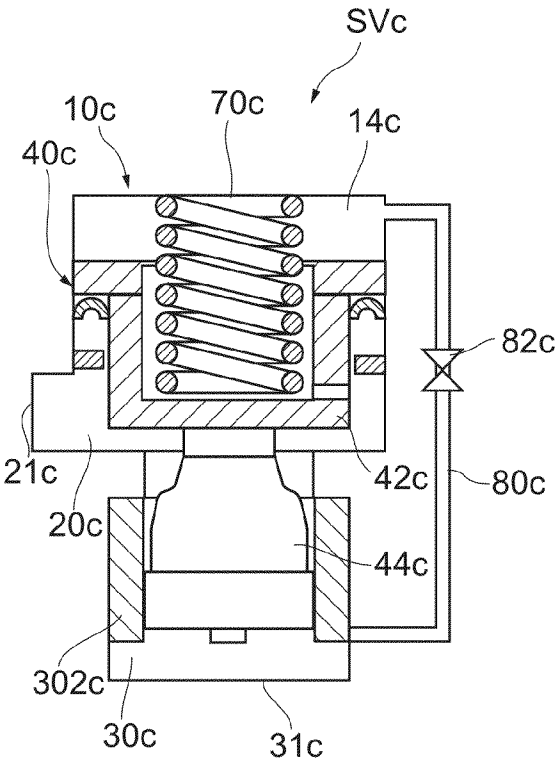
Figure 17C:
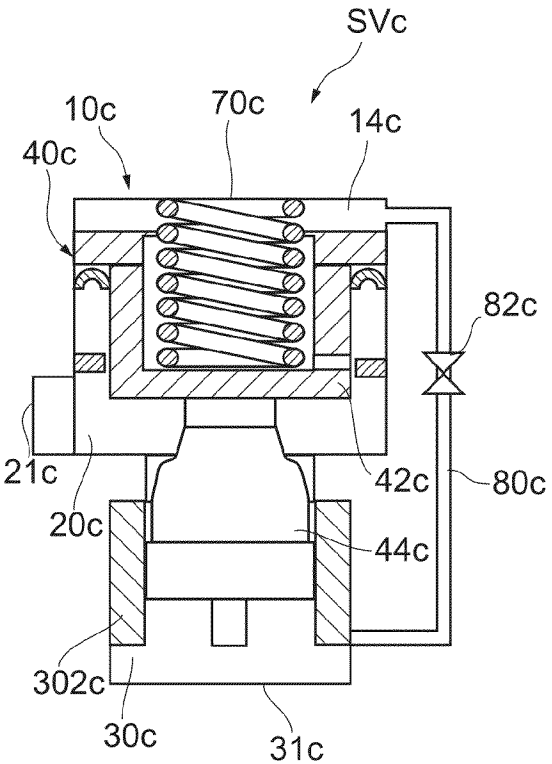

Next, an operation of the flush valve SVc will be described with reference to FIG. 17. FIG. 17 includes diagrams for illustrating a water discharge operation of the flush valve SVc shown in FIG. 16. FIG. 17(*a*) shows a state of the flush valve SVc before water discharge, FIG. 17(*b*) shows a state of the flush valve SVc with the sub-valve 82*c* opened, and FIG. 17(*c*) shows a state of the flush valve SVc during water discharge while the flow rate of water is adjusted.

As shown in FIG. 17(*a*), when the sub-valve 82*c* is closed, the same primary pressure as the primary pressure applied to the primary-side internal flow channel 20*c* is applied also to the back pressure chamber 14*c*. The main valve body 42*c* of the valve member 40*c* is pushed toward the outlet 31*c* by the primary pressure to come into close contact with the boundary surface of the primary-side internal flow channel 20*c* to the secondary-side internal flow channel 30*c*, thereby stopping water supply. In the state shown in FIG. 17(*a*), the spring 70*c* and the part corresponding to the main valve body 42*c* of the valve member 40*c* are not in contact with and are spaced apart from each other.

Then, as shown in FIG. 17(*b*), when the sub-valve 82*c* is opened, the water in the back pressure chamber 14*c* flows out. As the water in the back pressure chamber 14*c* flows out, the pressure in the back pressure chamber 14*c* decreases. As the pressure in the back pressure chamber 14*c* decreases, the valve member 40*c* moves upward to abut against the spring 70*c*. Since the spring 70*c* is disposed between the valve member 40*c* and the back pressure chamber 14*c*, the spring 70*c* shrinks to produce a repulsive force as the valve member 70*c* moves upward.

When the valve member 40*c* is pushed upward by the water pressure, and the spring 70*c* shrinks to maintain the balance as described above, as shown in FIG. 17(*c*), the main valve body 42*c* (the main valve body surface 421*c*) of the valve member 40*c* separates from the main valve seat surface 201*c* and then is kept at a predetermined position. Then, water flows from the primary-side internal flow channel 20 into the secondary-side internal flow channel 30*c* at a constant flow rate. The flow rate of the water flowing from the primary-side internal flow channel 20*c* into the secondary-side internal flow channel 30*c* is adjusted by the width of the gap between the constant flow rate valve body 44*c* and the secondary-side internal flow channel 30*c*.

Then, when the sub-valve 82*c* is closed, water flows into the back pressure chamber 14*c* through the narrowed flow channel 162*c* (see FIG. 16) and the hole 462*c* until the back pressure chamber 14*c* is filled with water, and as a result, the primary pressure is applied to push the valve member 40*c* downward until the main valve body 42*c* (the main valve body surface 421*c*) abuts against the main valve seat surface 201*c* (see FIG. 16) to stop water supply.

Figure 18:
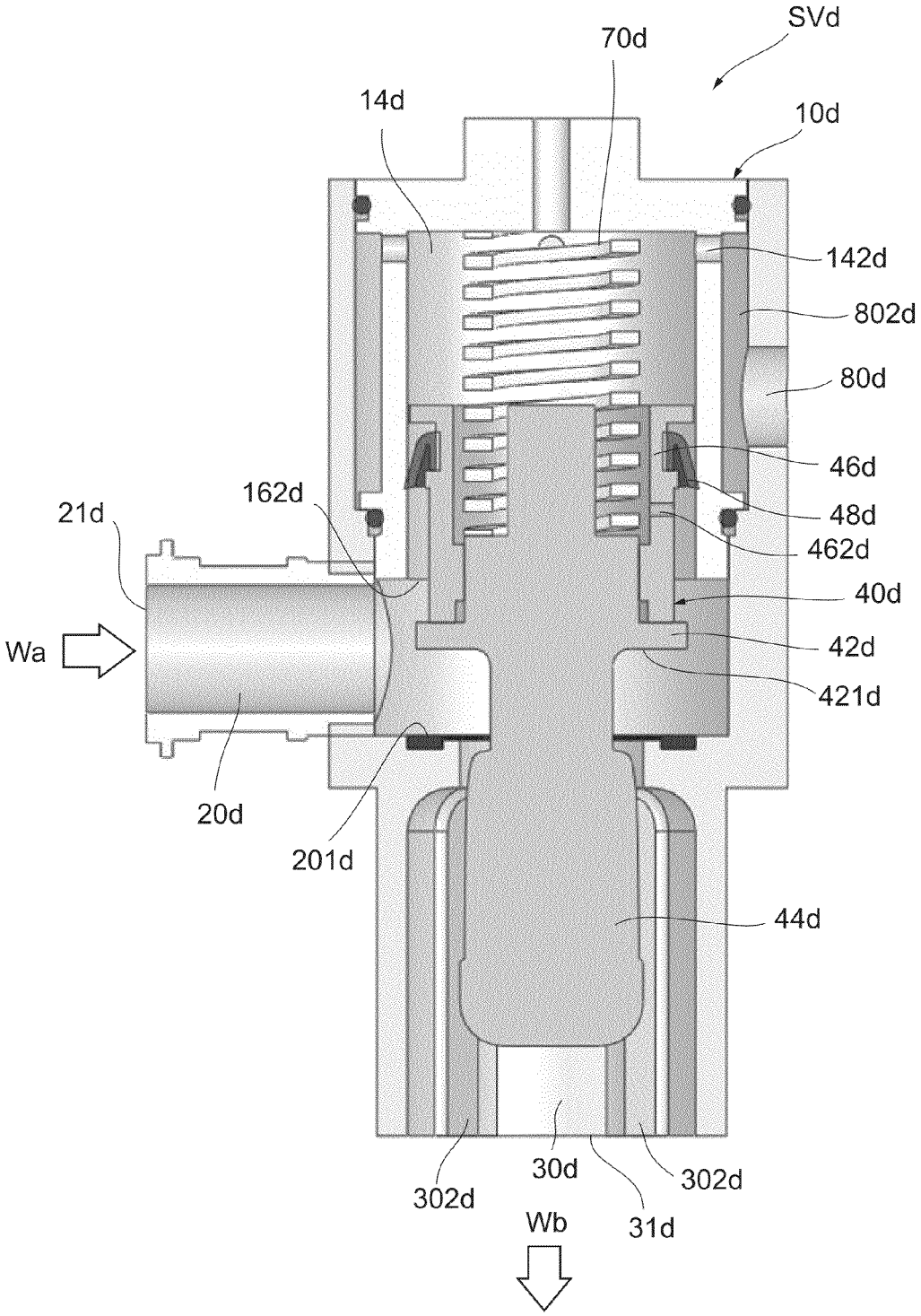
FIG. 18 is a diagram showing a configuration of an example of the actually constructed flush valve shown in FIG. 16.
Figure 19:
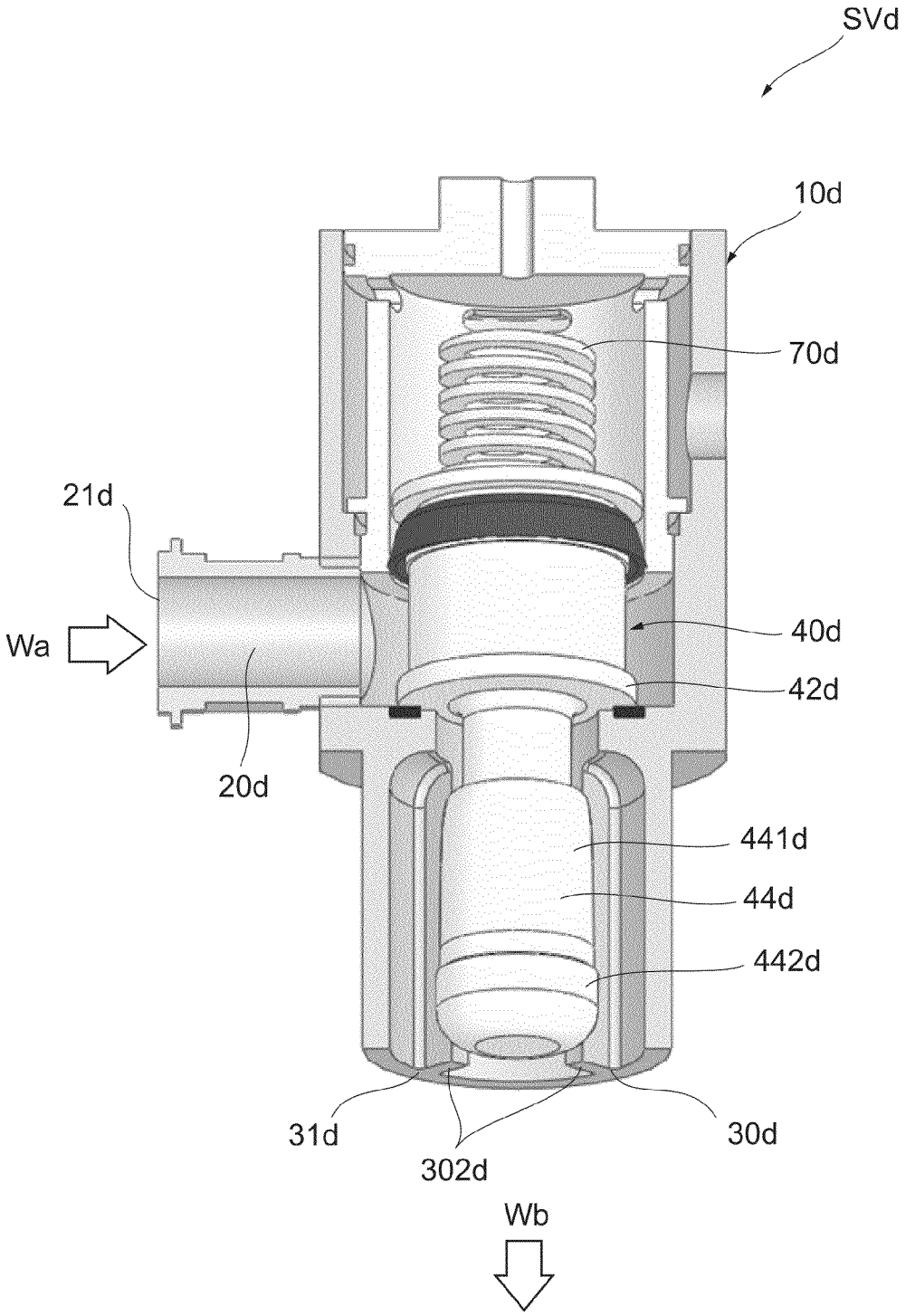
FIG. 19 showing the configuration of the example of the actually constructed flush valve shown in FIG. 16.

Next, as an example of the actually constructed flush valve SVc shown in FIG. 16, a flush valve SVd will be described with reference to FIGS. 18 and 19. FIG. 18 is a diagram showing a configuration of the flush valve SVd, which is an example of the actually constructed flush valve SVc shown in FIG. 16. FIG. 19 is also a diagram showing a configuration of the flush valve SVd viewed from diagonally below.

As shown in FIGS. 18 and 19, the flush valve SVd has a main body part 10*d*. In the main body part 10*d*, a primary-side internal flow channel 20*d*, a secondary-side internal flow channel 30*d* and back pressure chamber 14*d* are formed. The primary-side internal flow channel 20*d* receives the influent water Wa from a primary-side flow channel, which is a water supply source, and feeds the water to the secondary-side internal flow channel 30*d*. An inlet 21*d* is provided at an upstream end of the primary-side internal flow channel 20*d*. The inlet 21*d* is an opening for receiving the influent water Wa and feeding the water to the primary-side internal flow channel 20*d*.

The secondary-side internal flow channel 30*d* feeds influent water from the primary-side internal flow channel 20*d* to a secondary-side flow channel, which is a water supply destination, as effluent water Wb. An outlet 31*d* is provided at a downstream end of the secondary-side internal flow channel 30*d*. The outlet 31*d* is an opening for feeding the effluent water Wb from the secondary-side internal flow channel 30*d* to the secondary-side flow channel.

A valve member 40*d* having a main valve body 42*d* that opens and closes the flow channel between the primary-side internal flow channel 20*d* and the secondary-side internal flow channel 30*d* is disposed between the primary-side internal flow channel 20*d* and the secondary-side internal flow channel 30*d*. One end of the valve member 40*d* on the downstream side is inserted into the secondary-side internal flow channel 30*d*, and the opposite end faces the back pressure chamber 14*d*. The valve member 40*d* is disposed so as to be capable of moving back and forth in the direction of extension of the secondary-side internal flow channel 30*d*.

A surface of the main valve body 42*d* on the downstream side forms a main valve body surface 421*d*. When the valve member 40*d* is pushed to the downstream limit, the main valve body surface 421*d* abuts against a boundary surface of the primary-side internal flow channel 20*d* to the secondary-side internal flow channel 30*d*, thereby blocking the flow of water between the primary-side internal flow channel 20*d* and the secondary-side internal flow channel 30*d*. Thus, the boundary surface against which the main valve body surface 421*d* abuts functions as a main valve seat surface 201*d* (a main valve seat).

A constant flow rate valve body 44*d* (constant flow rate keeping part) is provided on the valve member 40*d* in a part downstream of the main valve body 42*d*. The constant flow rate valve body 44*d* has an inclined surface 441*d* (an outer surface) and an abutment part 442*d* (a guide part or stabilizing part). The abutment part 442*d* is provided to abut against flow channel side protrusions 302*d* (guide parts or stabilizing part) formed on the side wall of the secondary-side internal flow channel 30*d*. A plurality of flow channel side protrusions 302*d* is provided along the perimeter of the flow channel so as to abut against the abutment part 442*d* at different positions. Since the abutment part 442*d* abuts against the flow channel side protrusions 302*d* when the valve member 40*d* slides back and forth, the valve member 40*d* can stably slide without being inclined.

Since the distance between the inclined surface 441*d* of the constant flow rate valve body 44*d* and the inner side wall of the secondary-side internal flow channel 30*d* is variable, the inner side wall of the secondary-side internal flow channel 30*d* serves as a constant flow rate valve seat for the constant flow rate valve. The inclined surface 441*d* is formed so as to come closer to the inner side wall of the secondary-side internal flow channel 30*d* as it goes from the main valve body 42*d* toward the outlet 31*d*.

Consequently, when the valve member 40*d* moves upward (in the direction to enter the back pressure chamber 14*d*) so as to allow water to pass through between the primary-side internal flow channel 20*d* and the secondary-side internal flow channel 30*d*, the minimum distance between the inclined surface 441*d* of the constant flow rate valve body 44*d* and the inner side wall of the secondary-side internal flow channel 30*d* decreases, so that the flow rate of water decreases. If the valve member 40*d* once moving upward (in the direction to enter the back pressure chamber 14*d*) so as to allow water to pass through between the primary-side internal flow channel 20*d* and the secondary-side internal flow channel 30*d* then moves downward (in the direction toward the outlet 31*d*), the minimum distance between the inclined surface 441*d* of the constant flow rate valve body 44*d* and the inner side wall of the secondary-side internal flow channel 30*d* increases, so that the flow rate of water increases.

The valve member 40*d* has a housing hollow part 46*d* provided on the opposite side of the main valve body 42*d* to the constant flow rate valve body 44*d*. The housing hollow part 46*d* has the shape of a recess that retreats from the back pressure chamber 14*d*. A U-packing 48*d* is provided at an end of the housing hollow part 46*d* closer to the back pressure chamber 14*d*. The U-packing 48*d* is disposed so as to abut against the inner side wall of the main body part 10*d* in a part closer to the secondary-side internal flow channel 30*d* than the back pressure chamber 14*d*.

As described above, the abutment part 442*d* abuts against the flow channel side protrusions 302*d* at one end of the valve member 40*d*, and the U-packing 48*d* abuts against the inner side wall of the main body part 10*d* at the other end of the valve member 40*d*. Thus, the valve member 40*d* is designed to slide with its opposite ends held so as to prevent inclination of the valve member 40*d*.

A gap, which serves as a narrowed flow channel 162*d*, is formed between the U-packing 48*d* and the main valve body 42*d*. Thus, water flows from the primary-side internal flow channel 20*d* into a space between the housing hollow part 46*d* and the inner side wall of the main body part 10*d* at a speed reduced by the narrowed flow channel 162*d*.

The housing hollow part 46*d* has a hole 462*d* that connects an intermediate chamber 18*d* and the back pressure chamber 14*d* to each other. Therefore, water flows from the primary-side internal flow channel 20*d* into the back pressure chamber 14*d* through the hole 462*d*.

A spring 70*d* (constant flow rate keeping part) having a linear characteristic is disposed between the upper wall surface of the back pressure chamber 14*d* and the housing hollow part 46*d*. The spring 70*d* is housed in the housing hollow part 46*d* at one end and abuts, at the other end, against the upper wall surface of the back pressure chamber 14*d*.

According to this embodiment, the primary pressure is applied to the main valve body surface 421*d*, and the spring 70*d* is disposed so as to produce a force that resists the primary pressure, so that the main valve body surface 421*d* serves also as a pressure receiving surface.

The back pressure chamber 14*d* and the secondary-side internal flow channel 30*d* are connected to each other by a bypass flow channel 80*d*. A sub-valve is provided on the bypass flow channel 80*d*. If the sub-valve is closed, and the back pressure chamber 14*d* is filled with water, the primary pressure is applied in the back pressure chamber 14*d*. If the sub-valve is opened, the water in the back pressure chamber 14*d* flows to the secondary-side internal flow channel 30*d* through the bypass flow channel 80*d*, and the internal pressure of the back pressure chamber 14*d* decreases.

According to this embodiment, the constant flow rate valve body 44*d* has the inclined surface 441*d* (the outer surface) that comes closer to the side wall surface of the secondary-side internal flow channel 30*d* serving as the constant flow rate valve seat as it goes toward the outlet 31*d*.

The constant flow rate valve body 44*d* has the inclined surface 441*d* that comes closer to the constant flow rate valve seat as it goes toward the outlet so that the relationship between the displacement of the valve member and the main flow rate has a non-linear characteristic. With such a configuration, the main flow rate does not vary even if the spring 70*d* having a linear characteristic is used, and the constant flow rate valve body 44*d* separates from the constant flow rate valve seat when the valve member 40*d* is driven so that the main valve body 42*d* comes closer to the main valve seat 201*d*, so that deterioration of the responsibility can be prevented. Since the water flowing from the main valve body 42*d* is directed toward the outlet 31*d* by the constant flow rate valve body 44*d*, wastes would otherwise tend to accumulate in the region particularly when the flow rate is low. However, since the constant flow rate valve body 44*d* is spaced apart from the constant flow rate valve seat in this region, the possibility of clogging of wastes is reduced, and any clogging wastes can be removed by the water flowing when the valve is opened.

According to this embodiment, the spring 70*d* is disposed so as to apply, to the main valve body 42*d*, a force that balances with the force applied thereto by the primary pressure in the primary-side internal flow channel 20*d*, the valve member 40*d* having the hollow part 46*d* that houses one end part of the spring 70*d* is provided as a supporting member, and the hollow part 46*d* is recessed in the direction in which the main valve body 42*d* comes closer to the main valve seat 201*d*.

The spring 70*d* is intended to produce a force that balances with the force applied by the variable primary pressure, and therefore, the spring 70*d* is preferably as long as possible to reduce the displacement sensitivity and variations of the load change. Thus, the valve member 40*d* having the hollow part that is recessed in the direction in which the main valve body 42*d* comes closer to the main valve seat 201*d* is provided as a supporting member, and the spring 70*d* is supported by the valve member 40*d* serving as the supporting member at one end, so that the length of the spring 70*d* can be increased with a simple arrangement while preventing an increase of the length of the whole of the main valve.

According to this embodiment, a space into which water flows from the primary-side internal flow channel 20*d* is formed between the part forming the hollow part 46*d* and the main body part 10*d*. Thus, vibrations of the valve member 40*d* can be reduced to stabilize the movement of the valve member 40*d*.

According to this embodiment, the hole 463*d* is formed in the side of the hollow part 46*d*, and the back pressure on the main valve body 42*d* increases so as to balance with the primary pressure in the primary-side internal flow channel 20*d* by the water flowing through the hole 463*d*. The water flows into the hollow part 46*d* through the hole 463*d* in a direction perpendicular to the direction of expansion and shrinkage of the spring 70*d*.

As described above, since the hole 463*d* through which water passes to increase the back pressure on the main valve body 42*d* and make the back pressure balance with the primary pressure is formed in the side of the hollow part 46*d* that is less sensitive to the pressure variation in the primary-side internal flow channel 20*d*, the movement of the valve member 40*d* can be stabilized. Furthermore, since the water having passed through the hole 463*d* flows into the hollow part 46*d* in the direction perpendicular to the direction of expansion and shrinkage of the spring 70*d*, the constant flow rate control can be stably achieved without influencing the expansion and shrinkage of the spring 70*d*.

REFERENCE SIGNS LIST

SV: flush valve (flow channel opening/closing apparatus)
SB: toilet bowl
TB: water supply pipe
10: main body part
20: primary-side internal flow channel
21: inlet
22: sub-primary flow channel
30: secondary-side internal flow channel
31: outlet
40: valve member (main valve)
42: main valve body
44: constant flow rate valve body (constant flow rate keeping part)
46: housing hollow part
48: C-ring (dampening member)
50: position controlling member
60: wall member
70: spring (constant flow rate keeping part)
80: bypass flow channel
82: sub-valve
12: sub-back pressure chamber
14: second back pressure chamber (back pressure chamber)
16: first back pressure chamber (back pressure chamber)
18: intermediate chamber
19: partition wall
122: hole
142: hole
161: narrowed part (delaying part)
162: narrowed flow channel (delaying part)
191: hollow part
192: narrowed part
201: main valve seat surface (main valve seat)
222: narrowed part (pulsation reducing part, attenuation mechanism)
421: main valve body surface (main valve body)
441: inclined surface (outer surface)
442: valve side protrusion (guide part, stabilizing part)
462: hole
464: space
602: lower wall member
604: C-ring
606: upper wall member
607: pressure receiving surface
Wa: influent water
Wb: effluent water

The invention claimed is:

1. A flow channel opening/closing apparatus that starts water supply to a toilet bowl in response to receiving an instruction to start water supply and autonomously stops water supply when a predetermined condition is met, comprising:

a main body part having an inlet for receiving water from a primary-side flow channel, which is a water supply source, and feeding water to a primary-side internal flow channel and an outlet for feeding water from a secondary-side internal flow channel to a secondary-side flow channel, which is a water supply destination;

a main valve having a main valve body and a main valve seat that open and close a flow channel between said primary-side internal flow channel and said secondary-side internal flow channel;

a bypass flow channel that connects said primary-side internal flow channel and said secondary-side internal flow channel to each other without via said main valve body and said main valve seat;

a sub-valve that opens and closes said bypass flow channel; and delaying part that delays closing of said main valve by maintaining said main valve open until a back pressure on said main valve body increases to balance with a primary pressure in said primary-side internal flow channel, when said sub-valve is opened to decrease the back pressure on said main valve body to open said main valve, water flows from said primary-side internal flow channel to said secondary-side internal flow channel, and then said sub-valve is closed, wherein said main valve incorporates constant flow rate keeping part that operates to keep constant a main flow rate of water flowing from said primary-side internal flow channel to said secondary-side internal flow channel, said constant flow rate keeping part has a constant flow rate valve body and a constant flow rate valve seat and operates to adjust the distance between said constant flow rate valve body and said constant flow rate valve seat, said main valve body and said constant flow rate valve body are formed as an integral valve member, said main valve body is disposed closer to said inlet than said constant flow rate valve body, said main valve body moves in a direction to reduce the flow rate when said valve member is driven in a direction to cause said constant flow rate valve body to reduce the flow rate, said main valve has a spring disposed so as to apply to said main valve body a force that balances with a force applied by the primary pressure in said primary-side internal flow channel, and the opening of said main valve body with respect to said main valve seat is adjusted in accordance with said primary pressure by the action of the spring.

2. The flow channel opening/closing apparatus according to claim 1, wherein said main valve has a position controlling member that moves in a direction of sliding of the integral valve member comprising said main valve body and said constant flow rate valve body to adjust the range of movement of the valve member, said spring adjusts the position of the position controlling member by applying to said position controlling member a force that balances with the force applied by said primary pressure and produces a greater repulsive force when said position controlling member moves in a direction to reduce the range of movement of said valve member, and said valve member and said position controlling member are separate from each other when said main valve body and said main valve seat abut against each other to close the flow channel between said primary-side internal flow channel and said secondary-side internal flow channel.

3. The flow channel opening/closing apparatus according to claim 2, wherein when said main valve and said sub-valve are closed, said position controlling member is kept at a farthest position from said valve member in the range of movement of the position controlling member by the repulsive force of said spring.

4. The flow channel opening/closing apparatus according to claim 3, wherein said delaying part has a back pressure chamber that accumulates water flowing into the back pressure chamber from said primary-side internal flow channel and is configured to apply said primary pressure in a direction to push said main valve body toward said main valve seat, a sub-back pressure chamber that applies a back pressure to push said position controlling member toward said valve member is provided on the opposite side of said position controlling member from said main valve, and a sub-primary flow channel that connects said primary-side internal flow channel and said sub-back pressure chamber to each other is provided.

5. The flow channel opening/closing apparatus according to claim 3, wherein pulsation reducing part that reduces a pulsation of said valve member caused by a pulsation of said primary pressure is provided.

6. The flow channel opening/closing apparatus according to claim 5, wherein said valve member has a pressure receiving surface that receives said primary pressure and is configured to be capable of moving back and forth in response to the pressure applied to the pressure receiving surface, and as said pulsation reducing part, an attenuation mechanism that attenuates a pulsation of said primary pressure is provided in a flow channel from said primary-side internal flow channel to said pressure receiving surface by reducing the cross-sectional area of the flow channel.

7. The flow channel opening/closing apparatus according to claim 6, wherein said spring is disposed in a back pressure chamber which, at least when said sub-valve is closed, does not permit water flowing from said primary-side internal flow channel to said secondary-side internal flow channel to pass therethrough but accumulates water flowing into the back pressure chamber from said primary-side internal flow channel and applies said primary pressure in a direction to push said main valve body toward said main valve seat.

8. The flow channel opening/closing apparatus according to claim 3, wherein said spring is configured so that the relationship between the applied load and the displacement has a linear characteristic, and said constant flow rate valve body has such an outer shape that the relationship between the displacement of said valve member and said main flow rate has a non-linear characteristic.

9. The flow channel opening/closing apparatus according to claim 3, wherein said valve member slides to make said main valve body abut against and separate from said main valve seat, and stabilizing part that prevents inclination of said valve member is provided to prevent said valve member from rubbing against a surrounding inner wall of said main body part and thereby being hindered from sliding smoothly.

10. The flow channel opening/closing apparatus according to claim 9, wherein said stabilizing part is a part of said valve member that serves as a guide part and comes into contact with a part of said main body part, thereby allowing said valve member to slide without being inclined.

11. The flow channel opening/closing apparatus according to claim 10, wherein said stabilizing part is a part of said valve member that serves as a guide part and comes into contact with a part of said primary-side internal flow channel and said secondary-side internal flow channel, thereby allowing said valve member to slide without being inclined.

* * * * *